US009404719B1

(12) United States Patent
Bowers

(10) Patent No.: US 9,404,719 B1
(45) Date of Patent: Aug. 2, 2016

(54) AMMUNITION CARTRIDGE AND CHAMBER, AND TOOLS FOR MAKING AND RELOADING SAME

(71) Applicant: William R. Bowers, Dallas, GA (US)

(72) Inventor: William R. Bowers, Dallas, GA (US)

( * ) Notice: Subject to any disclaimer, the term of this patent is extended or adjusted under 35 U.S.C. 154(b) by 0 days.

(21) Appl. No.: 14/726,453

(22) Filed: May 29, 2015

Related U.S. Application Data

(63) Continuation-in-part of application No. 29/516,665, filed on Feb. 4, 2015, and a continuation-in-part of application No. 29/516,668, filed on Feb. 4, 2015.

(60) Provisional application No. 62/116,099, filed on Feb. 13, 2015.

(51) Int. Cl.
*F41A 21/00* (2006.01)
*F42B 5/02* (2006.01)
*F42B 33/04* (2006.01)

(52) U.S. Cl.
CPC ..... *F42B 5/025* (2013.01); *F41A 21/00* (2013.01); *F42B 5/02* (2013.01); *F42B 33/04* (2013.01)

(58) Field of Classification Search
CPC ..... F42B 5/02; F42B 5/025
See application file for complete search history.

(56) References Cited

U.S. PATENT DOCUMENTS

| | | | | |
|---|---|---|---|---|
| 5,970,879 | A * | 10/1999 | Jamison | F41A 3/18 102/464 |
| 6,293,203 | B1 * | 9/2001 | Alexander | F42B 5/025 102/430 |
| 8,011,301 | B1 * | 9/2011 | Sloan | F42B 5/26 102/430 |
| 2006/0054045 | A1 * | 3/2006 | Emary | F42B 5/32 102/464 |
| 2006/0248773 | A1 * | 11/2006 | Kightlinger | F42B 5/025 42/77 |
| 2009/0211483 | A1 * | 8/2009 | Kramer | F42B 5/025 102/439 |
| 2011/0048269 | A1 * | 3/2011 | Schuster | F42B 5/025 102/470 |
| 2011/0174188 | A1 * | 7/2011 | Schuster | F42B 5/26 102/464 |
| 2011/0214583 | A1 * | 9/2011 | Dutch | F42B 5/025 102/464 |
| 2012/0180689 | A1 * | 7/2012 | Schuster | F42B 5/025 102/469 |

* cited by examiner

*Primary Examiner* — Gabriel Klein
(74) *Attorney, Agent, or Firm* — Law Office of Arthur M. Antonelli, PLLC

(57) ABSTRACT

A case for an ammunition cartridge including a tubular member having a central axis which includes: a head which includes, a head face which is disposed substantially perpendicular to the central axis, and an extraction groove adjacent to the head face, the extraction groove circumscribing the central axis; a body abutting the head which comprises an internal chamber, a bullet receiving end spaced from the body along the central axis, a convex curved segment abutting the body, the convex curved segment being a first circular curve having a first radius of approximately 0.0263 inches, a frusto-conical segment abutting the convex curved segment, and a concave curved segment abutting the frusto-conical segment, the concave curved segment being a second circular curve having a second radius of approximately 0.1049 inches.

22 Claims, 25 Drawing Sheets

AMMUNITION CARTRIDGE AND CHAMBER, AND TOOLS FOR MAKING AND RELOADING SAME

CROSS REFERENCE TO RELATED APPLICATIONS

This application claims the benefit of U.S. Provisional Application No. 62/116,099 filed on Feb. 13, 2015. This application is a continuation-in-part of U.S. Patent Application No. 29/516,665 filed on Feb. 4, 2015. This application is a continuation-in-part of U.S. Patent Application No. 29/516,668 filed on Feb. 4, 2015. The contents of these three applications are incorporated by reference herein in their entirety.

FIELD OF THE INVENTION

The present invention generally relates to firearms and ammunition. More particularly, this invention relates to a case for an ammunition cartridge, as well as ammunition cartridges that utilize the case. Further, the present invention relates to barrels that are chambered for the case, a sizing die and seating die for reloading used cases, a reamer for reaming a chamber in a barrel blank that may be suitable for ammunition cartridges which utilize the case, and headspace gauges for assessing the suitability of the chambered barrels for use with the ammunition cartridges.

BACKGROUND

Smaller ammunition cartridges allow sportsman, law enforcement, and the military to carry more ammunition. Accordingly, a need exists for new ammunition cartridges which may be used, for example, with an AR-15 weapon platform that is configured for 9 mm ammunition.

SUMMARY

Hence, the present invention is directed to a case for an ammunition cartridge, ammunition cartridges that utilize the case, a chambered barrel for firing the ammunition cartridges, a sizing die for reloading used cases, a reamer for reaming a chamber in a barrel blank that is suitable for ammunition cartridges which utilize the case, and headspace gauges for assessing the suitability of the chambered barrels for use with the ammunition cartridges.

In one embodiment, a case for an ammunition cartridge may include a tubular member having a central axis which comprises a head which includes a head face that is disposed substantially perpendicular to the central axis. The head further may include an extraction groove adjacent to the head face, the extraction groove circumscribing the central axis. The tubular member, without limitation, may include: a body abutting the head which comprises an internal chamber; a bullet receiving end spaced from the body along the central axis; a convex curved segment abutting the body, the convex curved segment being a circular curve having a first radius of approximately 0.0263 inches; a frusto-conical segment abutting the convex curved segment; and a concave curved segment abutting the frusto-conical segment, the concave curved segment being another circular curve having a second radius of approximately 0.1049 inches.

The convex curved segment may include a shoulder-neck junction, the shoulder-neck junction may be spaced from the head face along the central axis by approximately 0.6673 inches. The tubular member at the shoulder-neck junction may have a first reference outer diameter of approximately 0.2626 inches. Also, the tubular member may have an axial length that is measured along the central axis from the head face to the bullet receiving end. The axial length of the tubular member may be substantially equal to or less than 0.846 inches.

The concave curved segment may include a body-shoulder junction, the body shoulder junction may be spaced from the head face along the central axis by approximately 0.5699 inches. The tubular member at the body-shoulder junction may have a second reference outer diameter of approximately 0.3676 inches.

The bullet receiving end of the tubular member may have an outer diameter of approximately 0.2489 inches. The bullet receiving end may include a mouth of a passage. The passage may extend along the central axis to the internal chamber. The mouth may have an inner diameter of approximately 0.2211 inches.

The head further may include a rim abutting the extraction groove, and an opening on the head face, the opening extending toward the body and forming a pocket in the head. The body may include a flash hole connecting the pocket and the internal chamber. The flash hole may have a diameter of approximately 0.08 inches. A primer may be seated in the pocket, and the tubular member may be formed from a brass alloy.

A charge of propellant may be disposed in the internal chamber, and a bullet may be seated in the passage to form an ammunition cartridge for a firearm.

DESCRIPTION OF THE DRAWINGS

In the accompanying drawings, which form a part of the specification and are to be read in conjunction therewith and in which like reference numerals (or designations) are used to indicate like parts in the various views.

DESCRIPTION

Figure 2:
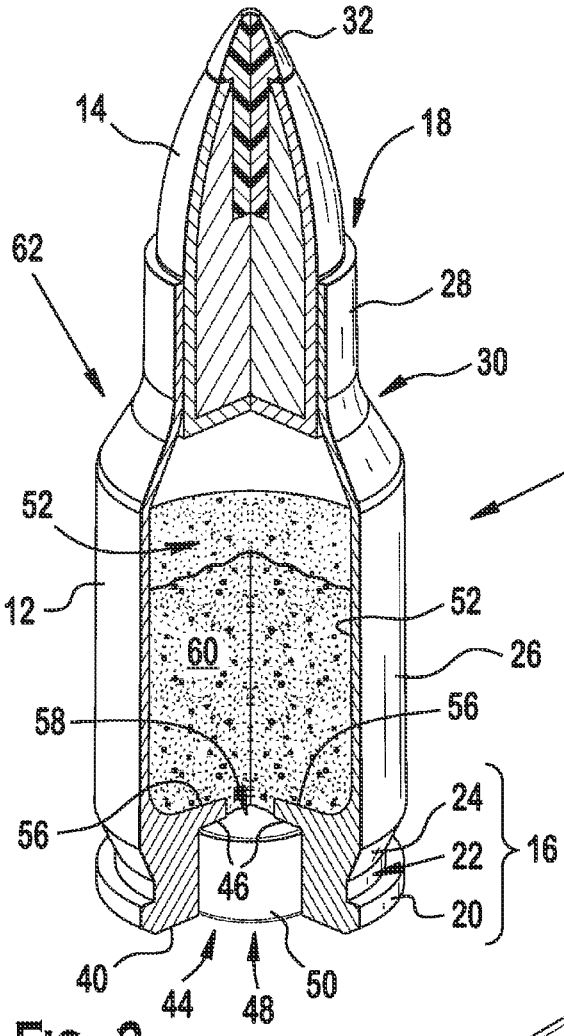
FIG. 2 is a cutaway perspective view of the ammunition cartridge of FIG. 1.
Figure 1:
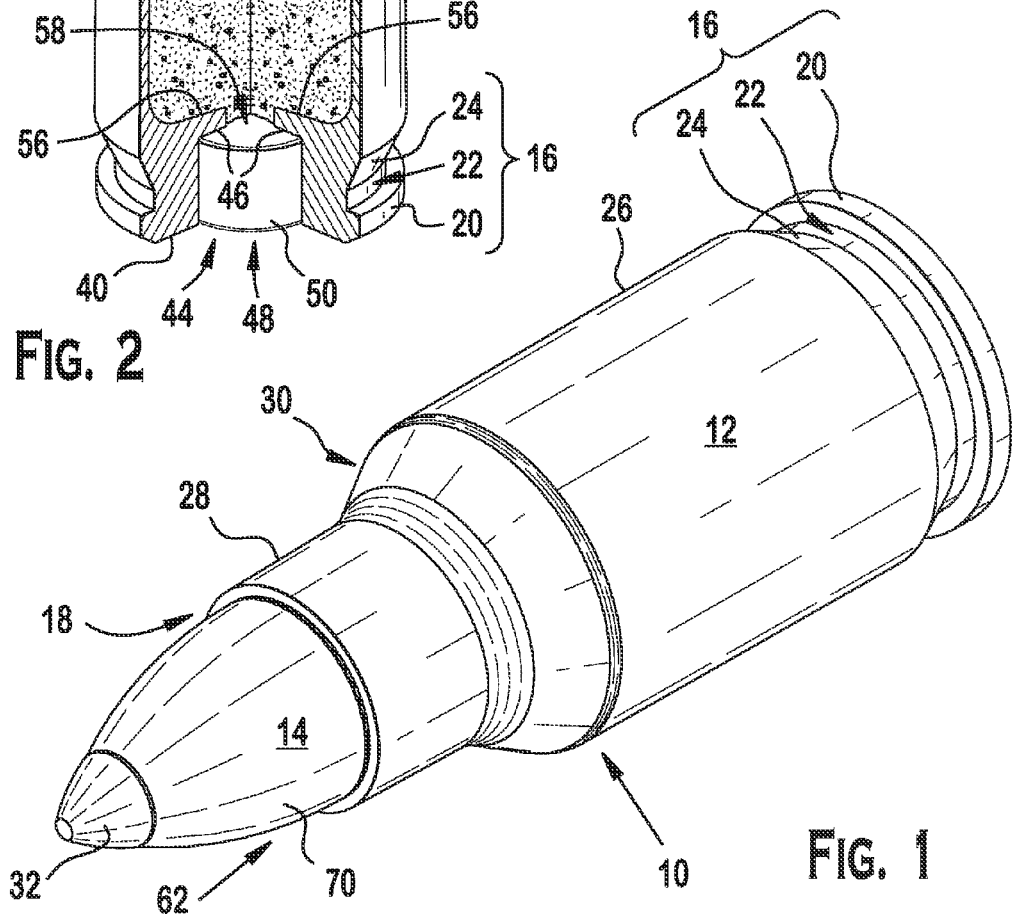
FIG. 1 is a perspective view of an exemplary embodiment of an ammunition cartridge in accordance with the present invention.

FIGS. 1 and 2 show an exemplary embodiment of an ammunition cartridge 10 in accordance with the present invention. The ammunition cartridge may include a case 12 and a bullet 14. The case may include a head 16 and a mouth 18. The head 16 may include a rim 20 and a groove 22 forward of the rim, as well as a rear shoulder 24. The case 12 may further include a body 26 adjacent the head, a neck 28 abutting the mouth, and a shoulder 30 disposed between the body 26 and the neck 28. The bullet 14 may be seated in the mouth 18 of the case. The bullet 14 may include a ballistic tip 32.

Referring to FIGS. 3, 4, 6, 8 and 9A, the case 12 may define a generally elongated cylindrical member. The exterior profile of the generally elongated cylindrical member may possess a bottleneck shape. The head 16 of the case may have approximately the same maximum outer dimension as the base 34 of the body 26. The outer dimension of the body 26, however, may taper gradually from the base 34 to the shoulder 30. The shoulder 30 may taper down to the neck 28.

Figure 9A:
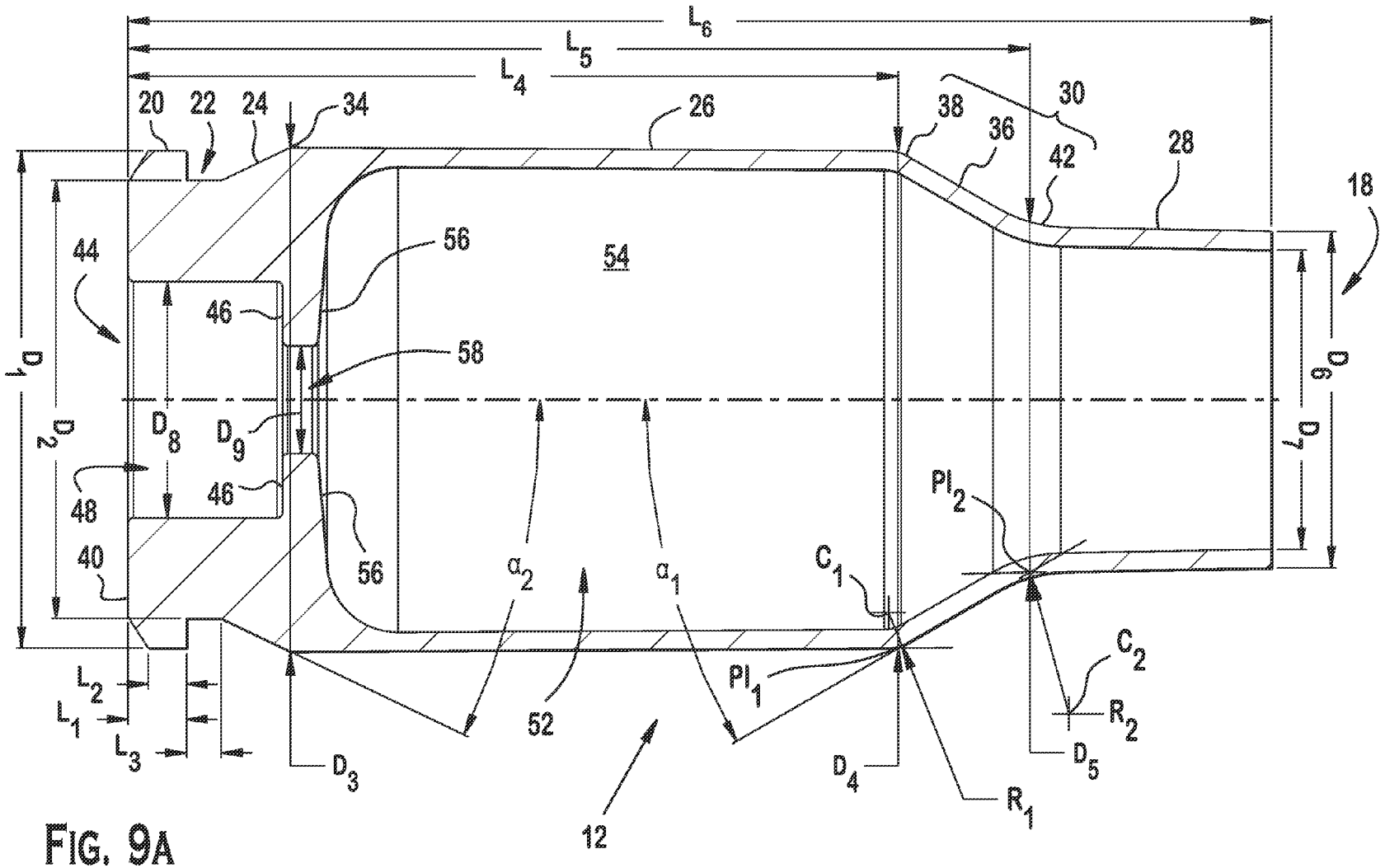
FIG. 9A is a cross-sectional view of the case of FIG. 3, along line 9A-9A.
Figure 9B:
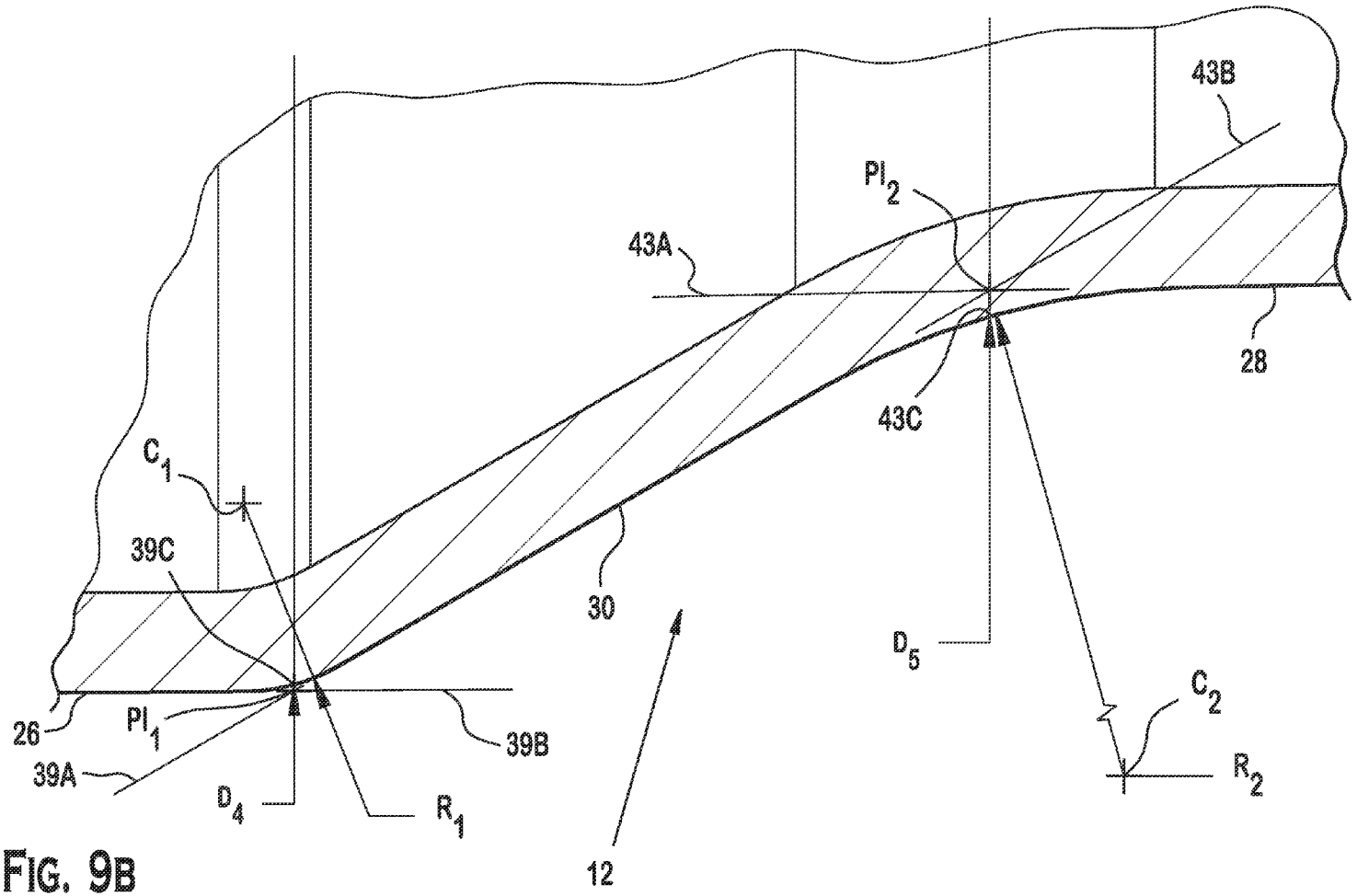
FIG. 9B is an expanded view of a portion of FIG. 9A.

As shown in FIG. 9A, the shoulder 30 may include a frusto-conical segment 36. Also, the shoulder 30 may include a curved segment of convex shape 38 that connects the body 26 and the frusto-conical segment 36. The curved segment of convex shape 38 may be a round that is formed by a circular curve having a center point $C_1$ and radius $R_1$. In this embodiment, radius $R_1$ measures 0.0263 inches. Referring to FIG. 9B, the point of intersection $PI_1$ of the tangent lines 39A, 39B of the circular curve may define a reference dimension for the case. As shown in FIG. 9A, the axial distance $L_4$, measured from the head face 40 to the point of intersection $PI_1$, may define a location on the circular curve 39C that delineates the junction of the base and shoulder of the case. The diameter of the case at this location 39 C may define another reference dimension for the case, namely the shoulder diameter $D_4$ (i.e., the diameter of the case where the shoulder ends).

The case 12 may include another curved segment of concave shape 42 that connects the frusto-conical segment 36 and the neck 28. The curved segment of concave shape 42 may be a fillet that is formed by a circular curve having a center point $C_2$ and radius $R_2$. In this embodiment, radius $R_2$ measures 0.1049 inches. As shown in FIG. 9B, the point of intersection $PI_2$ of the tangent lines 43A, 43B of the circular curve may define a reference dimension for the case. As shown in FIG. 9 A, the axial distance $L_5$ measured from the head face 40 to the point of intersection $PI_2$ may define a location on the circular curve 43C that delineates the junction of the shoulder and neck of the case. The diameter of the case at this location 43 C may define yet another reference dimension for the case, namely the headspace diameter $D_5$ (i.e., the diameter of the case where the shoulder starts).

The neck 28 of the case further may include a cylindrical portion of generally constant outer diameter $D_6$ which extends from the shoulder to the mouth end. The outer diameter of the neck 28, however, may taper gradually to the mouth 18 of the case in order to promote a better interface between a bullet and the case. Accordingly, the bottleneck shape of case may include a gradual reduction in the outer dimension of the cartridge case from the base diameter to the mouth.

Figure 8:
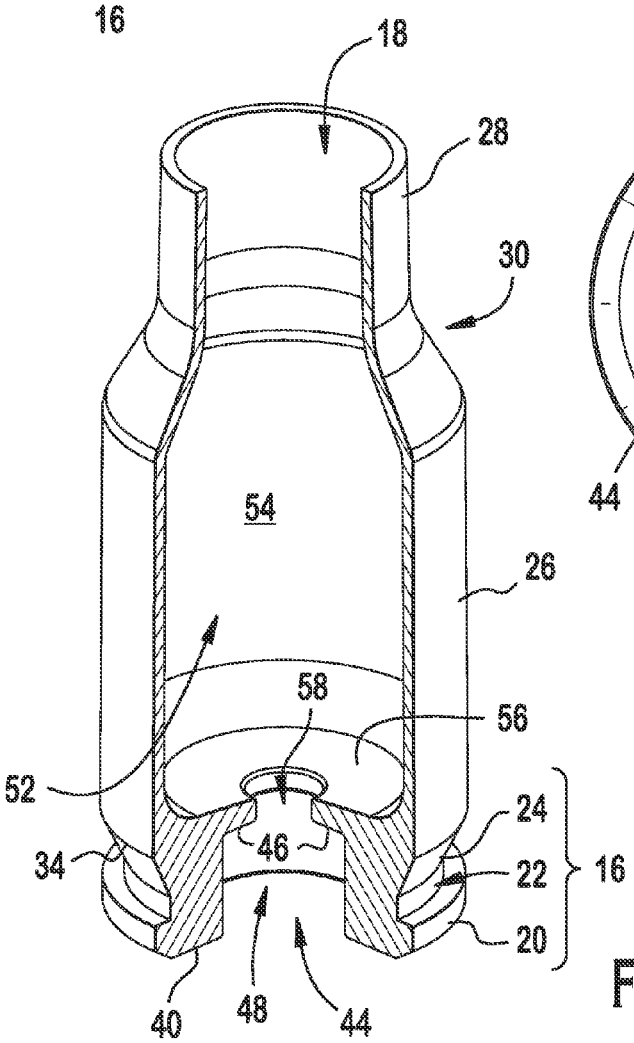
FIG. 8 is a cutaway perspective view of the case of FIG. 3.

As shown in FIGS. 2, 4, 7, 8 and 9A, the case 12 may include a bore 44 on the head face 40 that extends toward the body 26. The bore 44 may terminate at an end wall 46. Referring to FIGS. 2, 8 and 9, the bore 44 and end wall 46 may form a pocket 48 for receiving a primer 50. The primer 50 may be a commercial or military grade primer. For example, the primer may be a standard rifle primer manufactured by CCI Ammunition of Lewiston, Id.

Further, the case 12 may include an interior chamber 52. The lateral bounds of the interior chamber may be defined by an inner sidewall 54 of the case. The lower bounds of the interior chamber 52 may be defined by a seat 56 near the base of the case. The interior chamber 52 and the pocket 48 may be connected by one or more passages (or flash-holes) 58 that extend from the pocket end wall 46 through the seat 56.

Referring to FIGS. 2, 13A, 13B, and 13C, the interior chamber 52 may form a receptacle for containing a charge of smokeless propellant 60. The propellant(s) may be matched to each specific load for a desired pressure, velocity and/or accuracy. Additionally, the propellant(s) may be custom blended for each individual load to enhance value, performance or consistency lot to lot.

Figure 3:
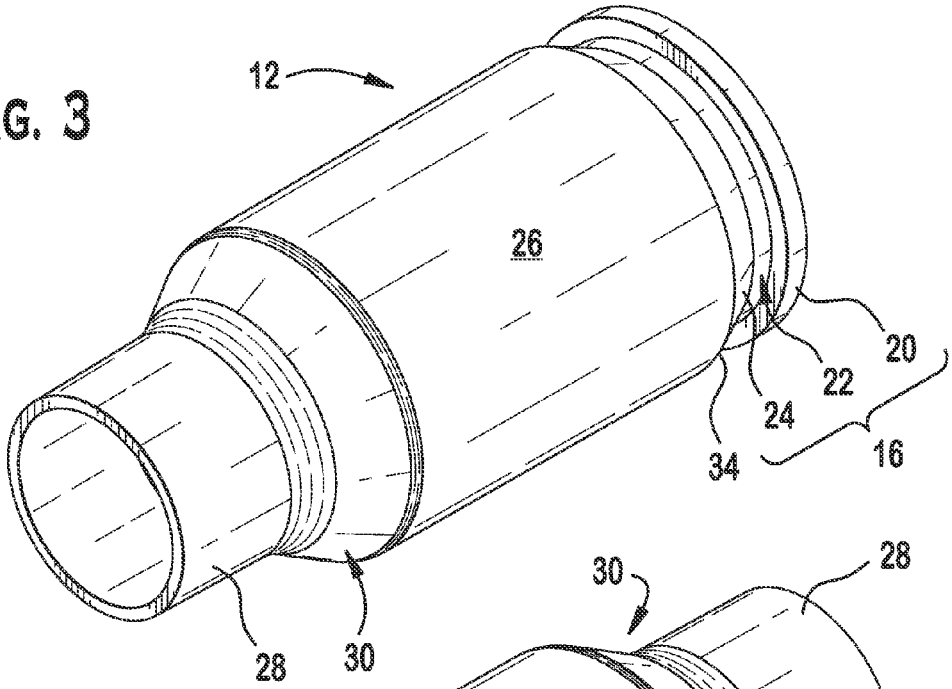
FIG. 3 is a perspective view of an exemplary embodiment of a case for an ammunition cartridge in accordance with the present invention.
Figure 4:
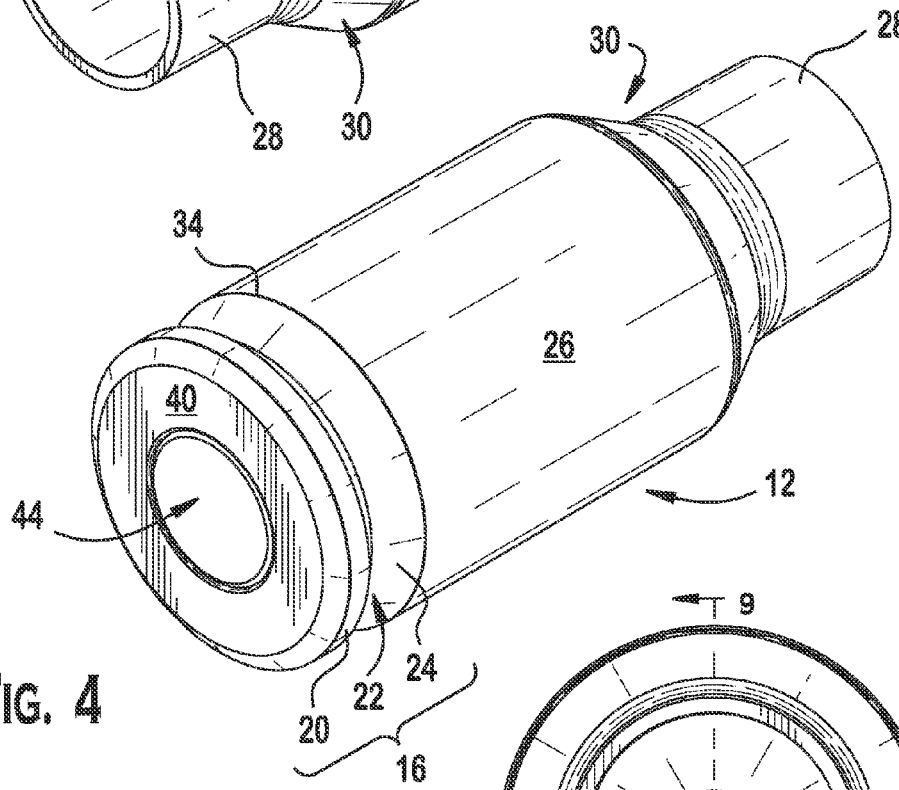
FIG. 4 is another perspective view of the case of FIG. 3.
Figure 5:
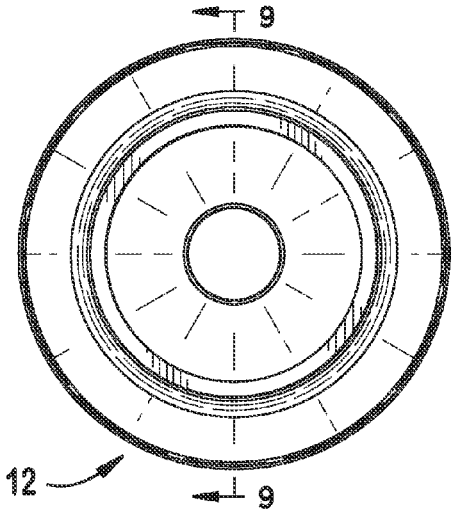
FIG. 5 is a front view of the case of FIG. 3.
Figure 6:
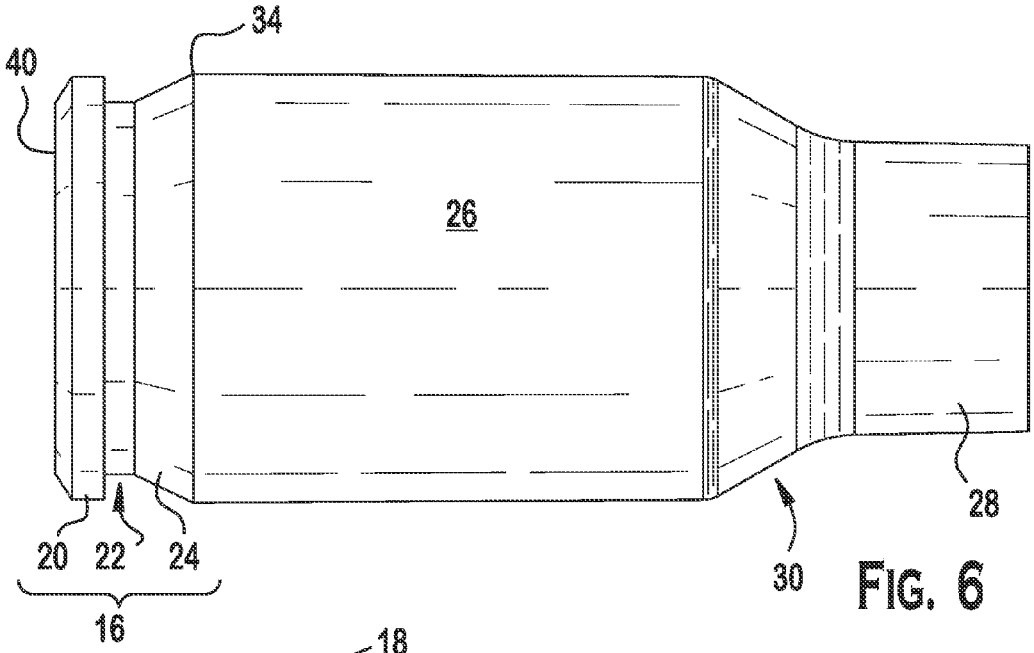
FIG. 6 is a side view of the case of FIG. 3.
Figure 7:
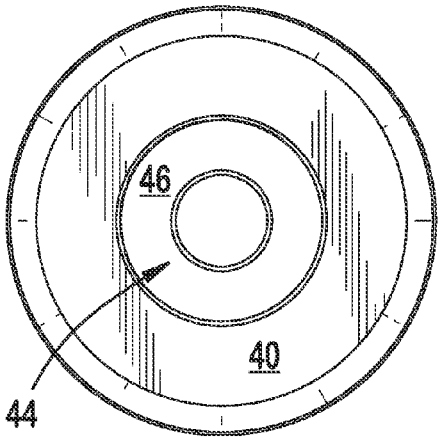
FIG. 7 is a rear view of the case of FIG. 3.

Exemplary dimensions for the case of FIG. 3 are shown in FIG. 9A and presented in Table 1 (below). Preferably, the case 12 may be formed from brass. Most preferably, the case 12 may be formed from military brass. The case, however, may be formed from other materials including, without limitation, aluminum, copper, steel, other metal alloys, polymer materials, and combinations thereof. Generally, other materials may be used to form the case provided that the other materials are resistant to corrosion, can withstand the internal pressures generated by cartridge operation, and can allow for manipulation via extraction and ejection without tearing.

TABLE 1

Exemplary Case Dimensions

| Description | Parameter | Measurement (a) |
|---|---|---|
| Rim thickness, overall | L1 | 0.0431 |
| Rim thickness | L2 | 0.0282 |
| Extraction groove thickness | L3 | 0.0257 |
| Axial length from head face to base-shoulder junction (b) | L4 | 0.5699 |
| Axial length from head face to shoulder-neck junction (b), (c) | L5 | 0.6673 |
| Case length | L6 | 0.8461 |
| Rim diameter | D1 | 0.3676 |
| Extraction groove diameter | D2 | 0.3237 |
| Base diameter | D3 | 0.3727 |
| Base-Shoulder junction diameter | D4 | 0.3676 |
| Shoulder-Neck junction diameter (c) | D5 | 0.2626 |
| Mouth, outer diameter | D6 | 0.2489 |
| Mouth, inner diameter | D7 | 0.2211 |
| Primer pocket, inner diameter | D8 | 0.1750 |
| Flash-hole, inner diameter | D9 | 0.0800 |
| Radius of circular curve, convex segment (round) | R1 | 0.0263 |
| Radius of circular curve, concave segment (fillet) | R2 | 0.1049 |
| Shoulder taper angle | $\alpha_1$ | 29.8970° |
| Head taper angle | $\alpha_2$ | 25.5640° |

Notes:
(a) Unless otherwise noted, unit dimensions measured in inches
(b) Dimensions are to intersection of tangent lines
(c) Reference dimension
(d) Case trim length for reloading: 0.838 inches; maximum case length for reloading: 0.840 inches.

Figure 10:
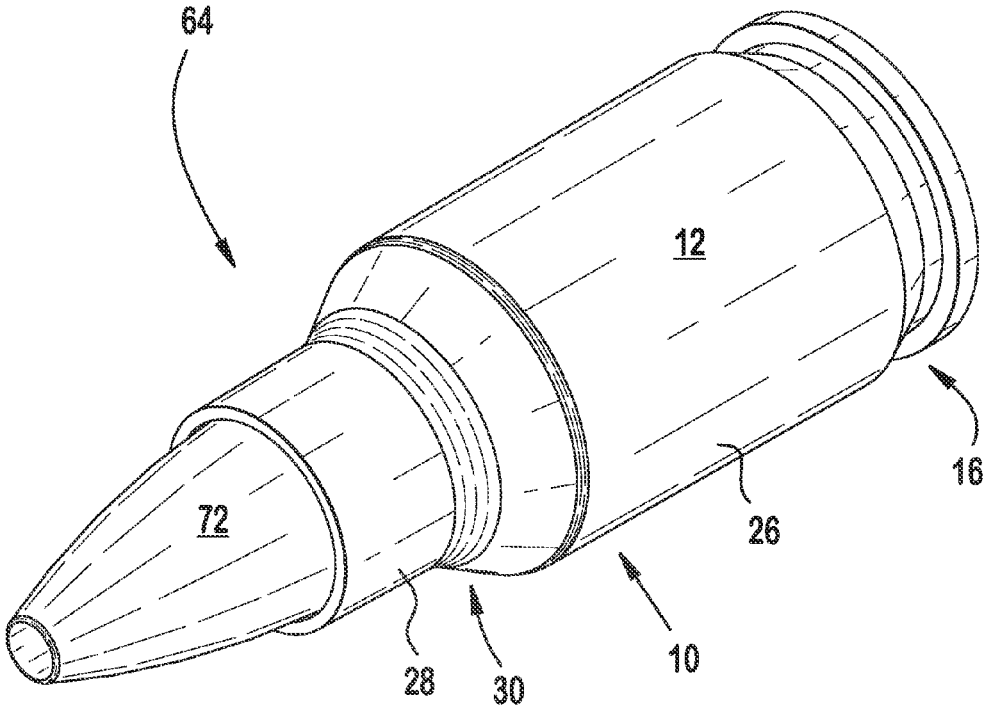
FIG. 10 is a perspective view of another embodiment of an ammunition cartridge in accordance with the present invention.
Figure 11:
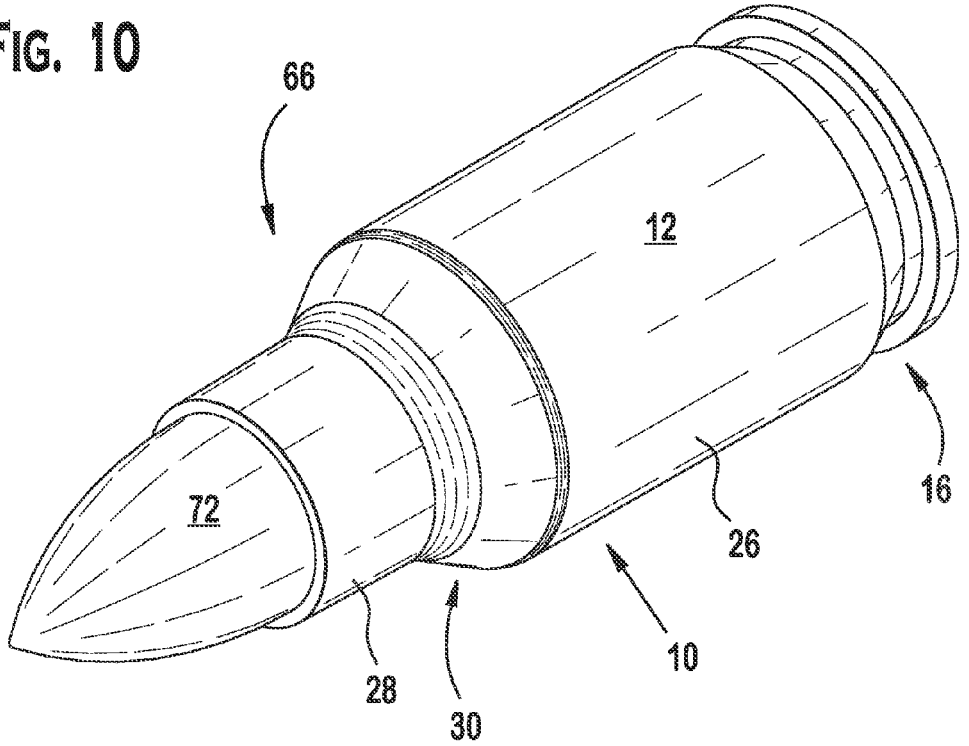
FIG. 11 is a perspective view of yet another embodiment of an ammunition cartridge in accordance with the present invention.

FIGS. 2, 10 and 11, respectively, show three exemplary ammunition cartridges 62, 64, 66, which utilize different bullets 70, 72, 74 in combination with the case 12 of FIG. 3 to form an ammunition cartridge 10 in accordance with the present invention.

Figure 13A:
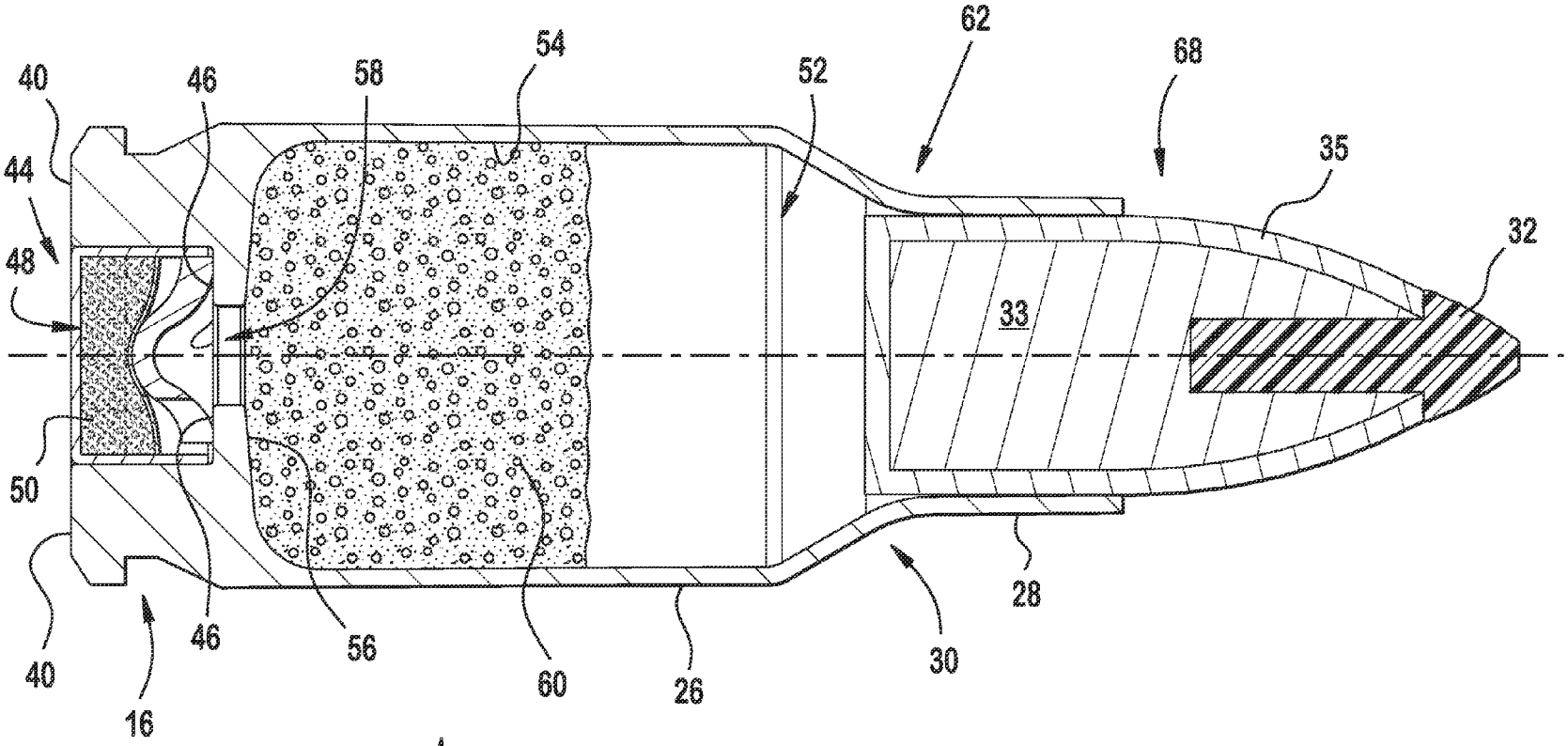
FIG. 13A is a cross-sectional view of the ammunition cartridge of FIG. 1, along line 13A-13A.

In FIGS. 1 and 13A, the bullet 68 is a 35 grain, .22 caliber, V-MAX®, bullet manufactured by Hornady Manufacturing Company, 3625 West Old Potash Hwy, Grand Island, Nebr. 68803. This bullet 68 includes a polymer tip 32, a lead core 33, and a surrounding guilding metal jacket 35. When used in combination with the case 12 of FIG. 3, the bullet 68 may form a fragmentation ammunition cartridge. Loading data for a preferred embodiment of an ammunition cartridge using the 35 grain, .22 caliber V-MAX® bullet and the case of FIG. 3 is presented in Table 2 (below).

Muzzle velocity for the bullet 68 of the preferred embodiment of the fragmentation ammunition cartridge 62 was measured using a "Master-Chrony" chronograph manufactured by SHOOTING CHRONY INC., 3840 East Robinson Rd., PMB #298, Amherst, N.Y. 14228. The cartridge 62 was fired from a 9 mm AR-15 platform with a 16-inch long barrel that was specifically chambered for the case 12 (see e.g., FIG. 14C). The bore of the barrel included a 1 in 9 twist rifling. Based on measurements from a 5 shot group, the 35 grain bullet achieved an average muzzle velocity of substantially equal to or greater than 2,800 feet per second.

Figure 13B:
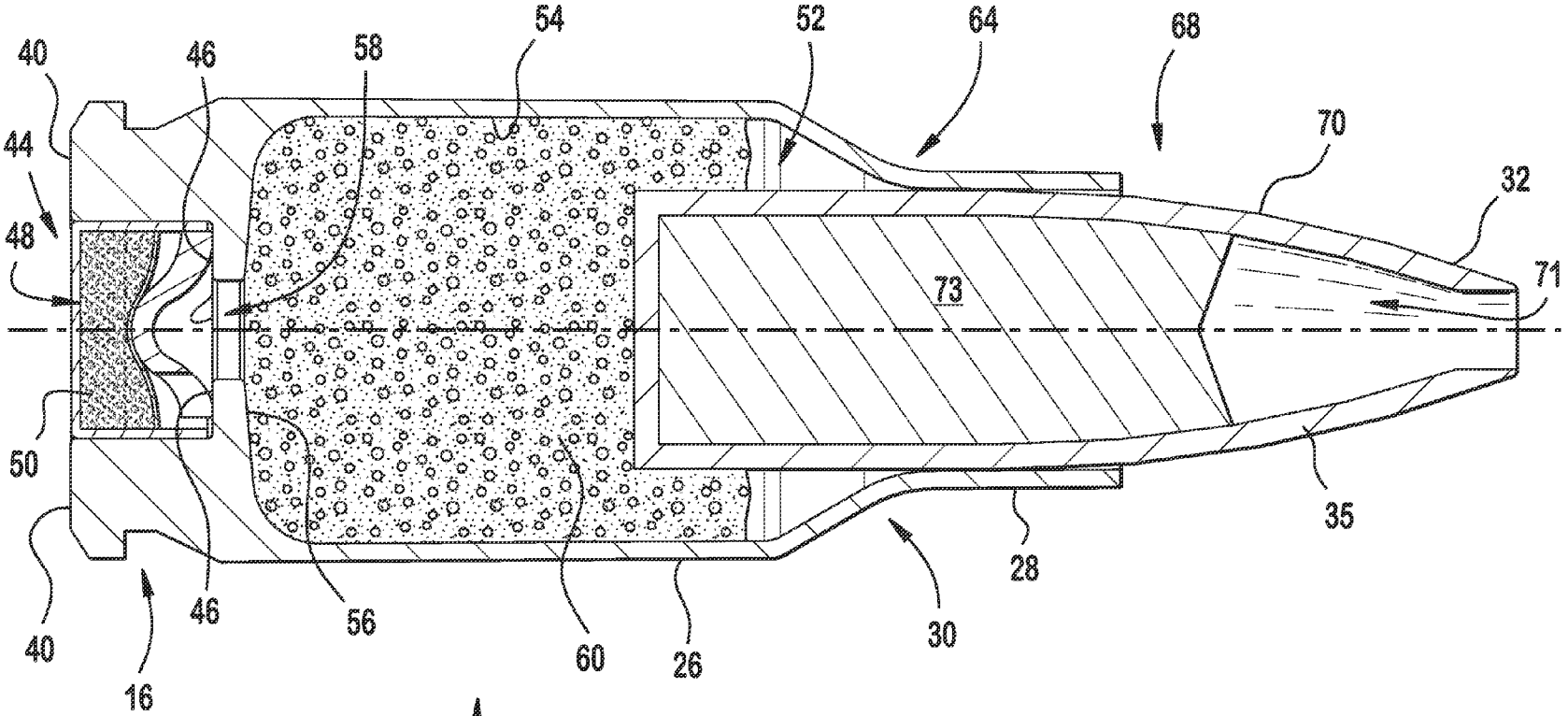
FIG. 13B is a cross-sectional view of the ammunition cartridge of FIG. 10, along line 13B-13B.

In FIGS. 10 and 13B, the bullet 70 is a 36 grain, Barnes .22 caliber Varmit Grenade® bullet manufactured by Barnes Bullets, LLC. 38 N Frontage Rd Mona, Utah 84645. This bullet 70 may include a hollow cavity 71 and frangible core 73 surrounded by a gilding metal jacket 35. The frangible core 73 may be formed from copper and tin powdered metal. When used in combination with the case 12 of FIG. 3 this bullet 70 may form a frangible ammunition cartridge 64. Loading data for a preferred embodiment of an ammunition cartridge using the 36 grain, .22 caliber, Varmit Grenade® bullet 70 and the case of FIG. 3 is presented in Table 2 (below).

TABLE 2

Exemplary Ammunition Cartridges

| Cartridge | Bullet Construction | Bullet Weight (grains) | Muzzle velocity (f) (feet per second) | Charge (grains) | Bullet (Manufacturer, Cal., Type, Item#) |
|---|---|---|---|---|---|
| Fragmentation | Polymer tip, lead core, surrounded by a guilding metal jacket, flat base | 35 | 2,800 | 5.6 (c) | Hornady (a), 22 cal., "V-max," 22252 |
| Frangible Core | Hollow-cavity, frangible core (copper-tin powdered metal core) surrounded by a guilding metal jacket, flat base | 36 | 2,600 | 5.8 (c) | Barnes (b), 22 cal., "Varmint Grenade," 22436 |
| Subsonic | Full Metal Jacket (copper and lead) | 55 | 950 | 2.5 (d) | Generic 22 cal. FMJ |

Notes:
(a) Hornady Manufacturing Company, 3625 West Old Potash Hwy, Grand Island, NE 68803
(b) Barnes Bullets, LLC. 38 N Frontage Rd Mona, UT 84645
(c) Hi-Skor 800-X double base smokeless propellant manufactured by Hodgdon Powder Company 6430 Vista Drive, Shawnee, KS 66218
(d) HS-6 ® double base smokeless propellant distributed by Hodgdon Powder Company 6430 Vista Drive, Shawnee, KS 66218
(e) Muzzle velocity measured in fps with an F-1 MASTER-CHRONY chronograph manufactured by SHOOTING CHRONY INC., 3840 East Robinson Rd., PMB # 298, Amherst, NY 14228
(f) Based on measurements from 5 shot groups, the bullets from each respective cartridge achieved an average muzzle velocity of substantially equal to or greater than the reported value.

Muzzle velocity for the bullet 70 of the preferred embodiment of the frangible ammunition cartridge 64 was measured using a Master-Chrony chronograph manufactured by SHOOTING CHRONY INC., 3840 East Robinson Rd., PMB #298, Amherst, N.Y. 14228. The cartridge 64 was fired from a 9 mm AR-15 platform with a 14-inch long barrel that was specifically chambered for the case (see e.g., FIG. 14C). The bore of the barrel included a 1 in 9 twist rifling. Based on measurements from a 5 shot group, the 36 grain bullet 70 achieved an average muzzle velocity of substantially equal to or greater than 2,600 feet per second.

Figure 13C:
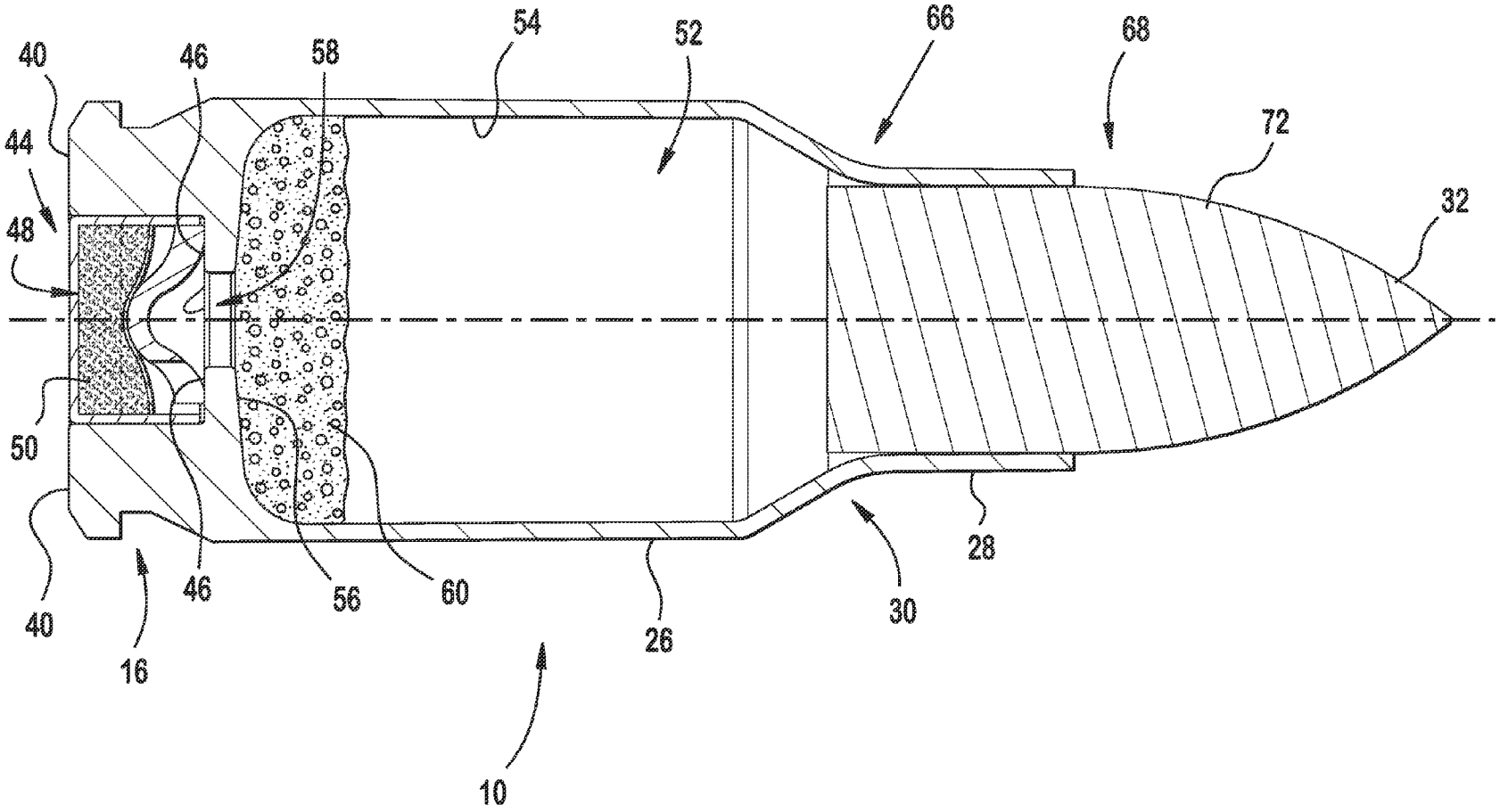
FIG. 13C is a cross-sectional view of the ammunition cartridge of FIG. 11, along line 13C-13C.

In FIGS. 11 and 13C, the bullet 72 is a 55 grain, .22 caliber, generic FMJ (full metal jacket) bullet.

When used in combination with the case 12 of FIG. 3, this bullet 72 may form a subsonic ammunition cartridge 66. Loading data for a preferred ammunition cartridge using the 55 grain, .22 caliber, generic FMJ bullet 72 and the case 12 of FIG. 3 are presented in Table 2 (below).

Muzzle velocity for the bullet 72 of the preferred embodiment of the subsonic ammunition cartridge 66 was measured using a Master-Chrony chronograph manufactured by SHOOTING CHRONY INC., 3840 East Robinson Rd., PMB #298, Amherst, N.Y. 14228. The cartridge was fired from a 9 mm AR-15 platform with a 14-inch long barrel that was specifically chambered for the case (see e.g., FIG. 14C). The bore of the barrel included a 1 in 9 twist rifling. Based on measurements from a 5 shot group, the 55 grain bullet 72 achieved an average muzzle velocity of substantially equal to or greater than 950 feet per second.

Moreover, other bullets may be used in combination with the case 12 of FIG. 3. For example, without limitation, a 55 grain, .22 caliber, soft point bullet may be used in combination with the case 12 of FIG. 3 as a substitute for the generic FMJ bullet in the subsonic ammunition cartridge described above.

FIG. 13A shows a schematic view of the 35 grain, .22 caliber. V-MAX® bullet 68 seated within the case 12 of FIG. 3. The total cartridge length $L_{TC}$ is 1.165 inches. In the preferred embodiment, 35 grain bullet ammunition cartridge 62 includes a charge of 5.5 grains of smokeless propellant 60. Preferably, the smokeless propellant 60 is Hi-Skor 800-X (a double-base, smokeless propellant) manufactured by Hodgdon Powder Company, 6430 Vista Drive, Shawnee, Kans. 66218.

FIG. 13B shows a schematic view of the 36 grain, .22 caliber, Varmit Grenade® bullet 70 seated within the case 12 of FIG. 3. The total cartridge length $L_{TC}$ is 1.165 inches. In the preferred embodiment, the 36 grain bullet ammunition cartridge 64 includes a charge of 5.8 grains of smokeless propellant 60. Preferably, the smokeless propellant 60 is Hi-Skor 800-X (a double-base, smokeless propellant) manufactured by Hodgdon Powder Company, 6430 Vista Drive, Shawnee, Kans. 66218.

FIG. 13C shows a schematic view of the 55 grain, .22 caliber, FMJ bullet 72 seated within the case of FIG. 3. The total length $L_{TC}$ of the 55 grain bullet ammunition cartridge 66 is 1.165 inches. In the preferred embodiment, the 55 grain bullet ammunition cartridge 66 includes a charge of 2.5 grains of smokeless propellant 60. Preferably, the smokeless propellant is HS-6® (a double-base, smokeless propellant) manufactured by Hodgdon Powder Company, 6430 Vista Drive, Shawnee, Kans. 66218.

Figure 12:
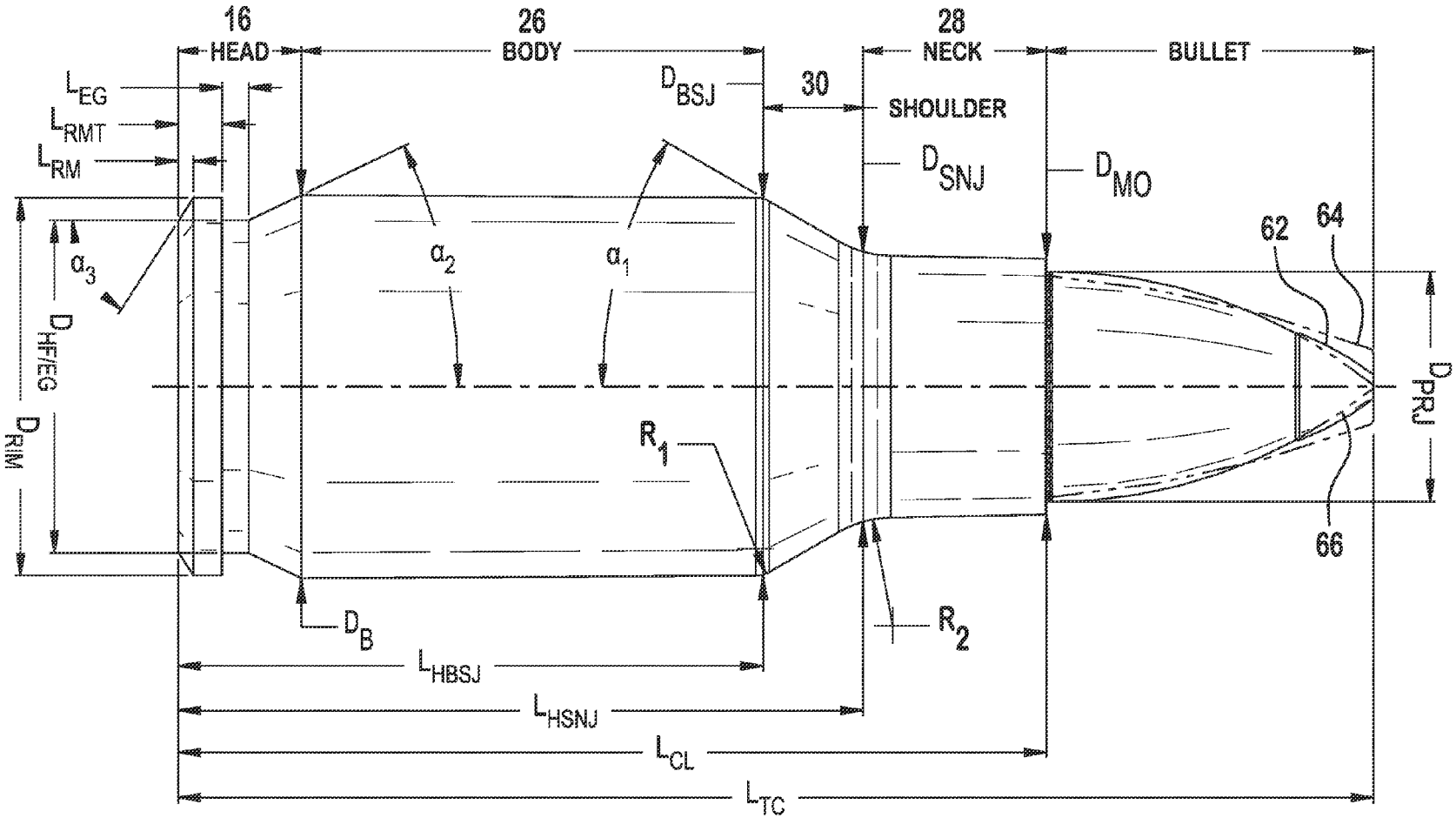
FIG. 12 is a side view of the profiles of the ammunition cartridges of FIGS. 1, 10 and 11.

Referring to FIG. 12, an ammunition cartridge (e.g., 62, 64, and 66) that utilizes the case 12 of FIG. 3 may have nominal dimensions intended to establish a standard cartridge type. Variations from the nominal dimensions may be tolerated by limited amounts. For example, diameters in FIG. 12 may have a tolerance of +0.000/−0.004 inch, except as otherwise noted. Table 3 (below) presents an exemplary set of nominal dimensions and tolerances for the standard cartridge type of FIG. 12.

TABLE 3

Nominal Dimensions for Exemplary Cartridge Type

| Description | Parameter | Dimension (a) | Tolerance (a) |
|---|---|---|---|
| Rim thickness, overall | $L_{RMT}$ | 0.045 | −0.010 |
| Rim thickness | $L_{RM}$ | 0.027 | −0.010 |
| Extraction groove thickness | $L_{EG}$ | 0.030 | +0.010 |
| Axial length from head face to base-shoulder junction (b) | $L_{HBSJ}$ | 0.5699 | — |

TABLE 3-continued

Nominal Dimensions for Exemplary Cartridge Type

| Description | Parameter | Dimension (a) | Tolerance (a) |
|---|---|---|---|
| Axial length from head face to shoulder-neck junction (b), (c) | $L_{HSNJ}$ | 0.6673 | — |
| Case length | $L_{CL}$ | 0.8461 | −0.020 |
| Rim diameter | $D_{RIM}$ | 0.378 | −0.010 |
| Head Face/Extraction groove diameter | $D_{HF/EG}$ | 0.332 | −0.020 |
| Base diameter | $D_B$ | 0.3727 | — |
| Base-Shoulder junction diameter (b) | $D_{BSJ}$ | 0.3676 | — |
| Shoulder-Neck junction diameter (b), (c); headspace | $D_{SNJ}$ | 0.2626 | — |
| Mouth, outer diameter | $D_{MO}$ | 0.2490 | — |
| Radius of circular curve, convex segment (round) | R1 | 0.0263 | — |
| Radius of circular curve, concave segment (fillet) | R2 | 0.1049 | — |
| Shoulder taper angle | $\alpha_1$ | 29.8970° | — |
| Head taper angle | $\alpha_2$ | 25.5640° | — |
| Rim taper angle | $\alpha_3$ | 35° | +20° |
| Cartridge length | $L_{TC}$ | 1.165 | −0.002 |
| Bullet diameter | $D_{PRJ}$ | 0.224 | −0.001 |

Notes:
(a) Unless otherwise noted, unit dimensions measured in inches
(b) Dimensions are to intersection of lines
(c) Reference dimension FIG. 14A is a perspective view of a cylindrical member 74 that includes a chamber that is configured and dimensioned for ammunition cartridges that utilize the case 12 of FIG. 9A, as well as the illustrative standard cartridge type disclosed in FIG. 12. The cylindrical member 74 may include a breech end 76 and a distal end 78. The cylindrical member 74 may include a chamber 80 and a bore 82. Collectively, the chamber 80 and the bore 82 may extend through the cylindrical member 74 from the breech end 76 to the distal end 78 along a central axis 84. The chamber 80 may include a body segment 86, a shoulder segment 88, a neck segment 90, and a throat segment (or free bore) 92. The bore 82 may extend from the distal side of the throat segment 92 to the distal end 78.

Figure 14B:
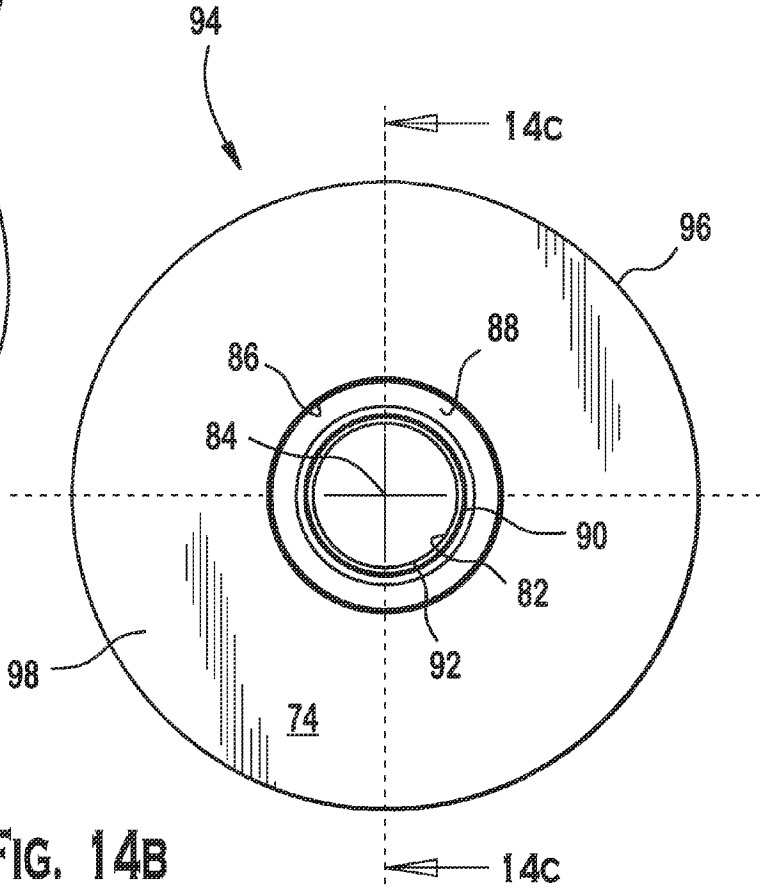
FIG. 14B is an elevation view of the breech face of the chamber of FIG. 14A.
Figure 14A:
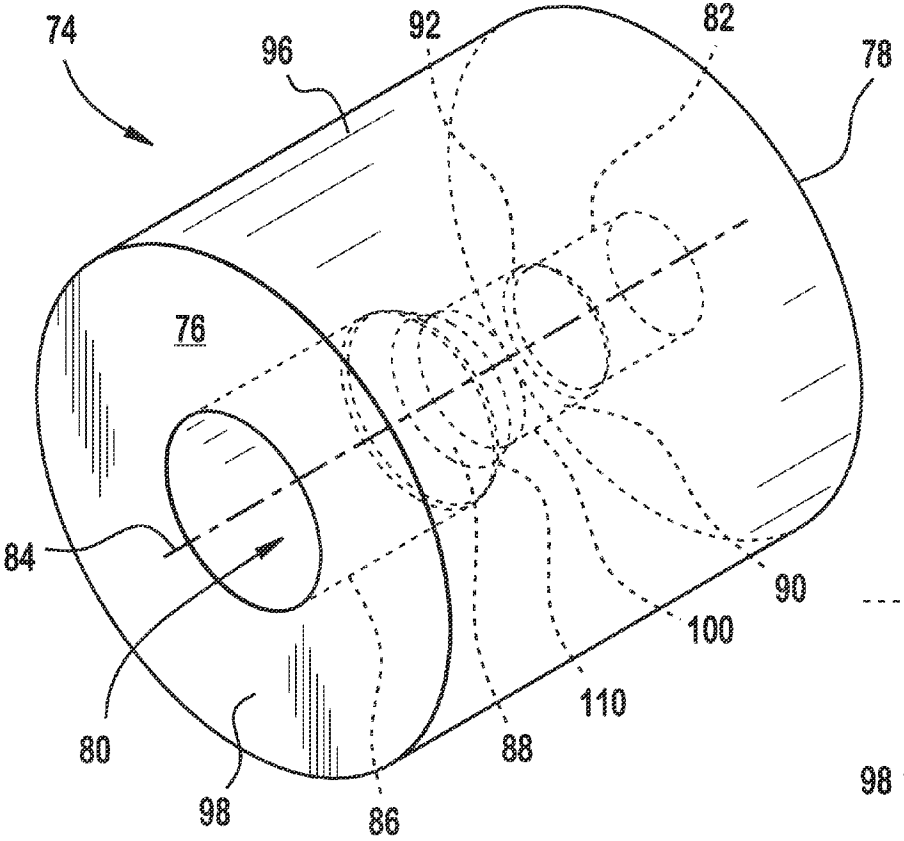
FIG. 14A is a perspective view of an exemplary embodiment of a cylindrical member which includes a chamber that is configured and dimensioned for use with the case of FIG. 3 and the ammunition cartridges of FIG. 12.

FIG. 14B is an elevation view of the breech end 76 of the cylindrical member 74 of FIG. 14A. Visible within the cylindrical member 74 is the body segment 86, shoulder segment 88, neck segment 90, and the throat segment (or free bore) 92 of the chamber 80. Also, visible from the breech end 76 is the bore 82.

Figure 14C:
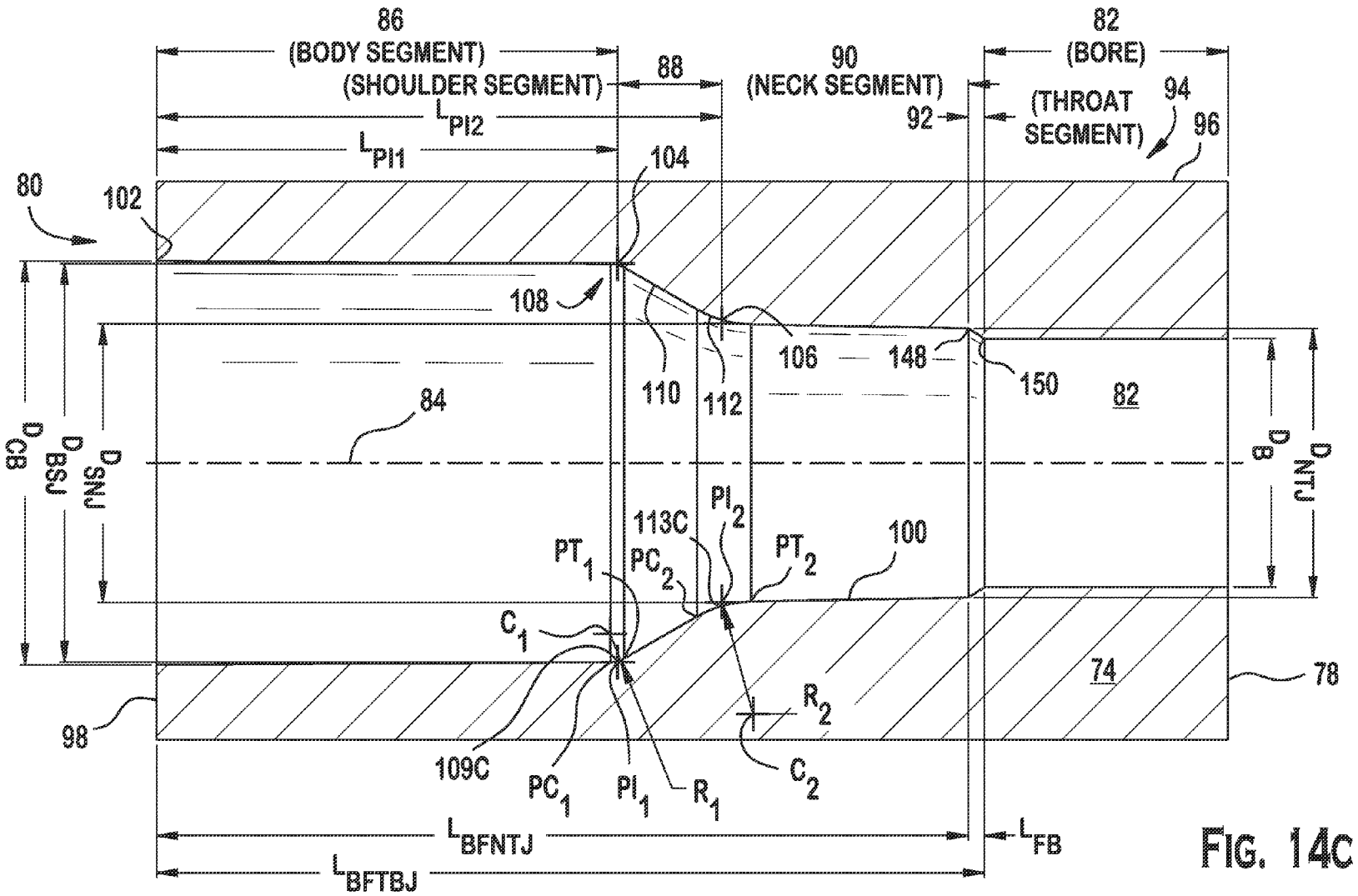
FIG. 14C is a cross-sectional view of the chamber of FIG. 14*b*, along line 14C-14C.

FIG. 14C is a cross-sectional view of the cylindrical member of FIG. 14B, along line 14C-14 C. The cross-section 94 of the cylindrical member may include an exterior profile 96. The exterior profile 96 may be symmetrical about the central axis 84. Although the exterior profile 96 may have uniform dimension as shown in FIG. 14C, the exterior profile of the cylindrical member may be non-uniform.

The chamber 80 may extend along the central axis 84 from the breech face 98 of the cylindrical member 74 toward the distal end 78 of the cylindrical member. The bore 82 may connect the chamber 80 to the distal end 78 of the cylindrical member. Further, the cross-section 94 may include an interior profile 100 that is symmetrical about the central axis 84. The interior profile 100 of the chamber may include a body segment 86, a shoulder segment 88, a neck segment 90, and a throat segment (or free bore) 92. The bore 82 may include a cross-sectional profile that is symmetrical about the central axis 84. Preferably, the bore 82 may include rifling.

The chamber 80 may extend along the central axis 84 from the chamber base ($S_{CB}$)) 102 to the base-shoulder junction ($S_{BSJ}$) 104. The shoulder segment 88 may extend along the central axis 84 from the base-shoulder junction ($S_{BSJ}$) 104 to the shoulder-neck junction ($S_{SNJ}$) 106. The profile of the shoulder segment 88 may include a concave circular curve 108, a straight line segment 110, and a convex circular curve 112.

Referring to FIG. 14B, the concave circular curve 108 may begin at a first point of curvature $PC_1$ and end at a first point of tangency $PT_1$. The concave circular curve 108 may have a center point $C_1$ and a radius $R_1$. In this embodiment, the radius $R_1$ may be 0.0263 inches. The point of intersection $PI_1$ of the tangents 113A, 113B may define a reference point. The point of intersection $PI_1$ may be spaced from the breech face 98 by axial length $L_{PI1}$. The point 113C on the concave curve 108 that is spaced from the breech face 98 by a distance equal to the axial length $L_{PI1}$ may be defined as the base-shoulder junction ($S_{BSJ}$) of the chamber. Referring to FIG. 14C, the diameter of the chamber 80 at the base-shoulder junction ($S_{BSJ}$) 104 may be a reference dimension for the chamber. Namely, the base-shoulder junction diameter $D_{BSJ}$ of the chamber.

One end of the straight line segment 110 of the shoulder segment 88 profile may connect to the first point of tangency $P_{T1}$ of the concave circular curve 108. The straight line segment 110 may form a shoulder angle β1 with respect to the central axis 84. In this embodiment, the shoulder angle β1 is approximately 29.8970 degrees. The other end of the straight line segment 110 may connect to the convex circular curve 112.

Figure 14D:
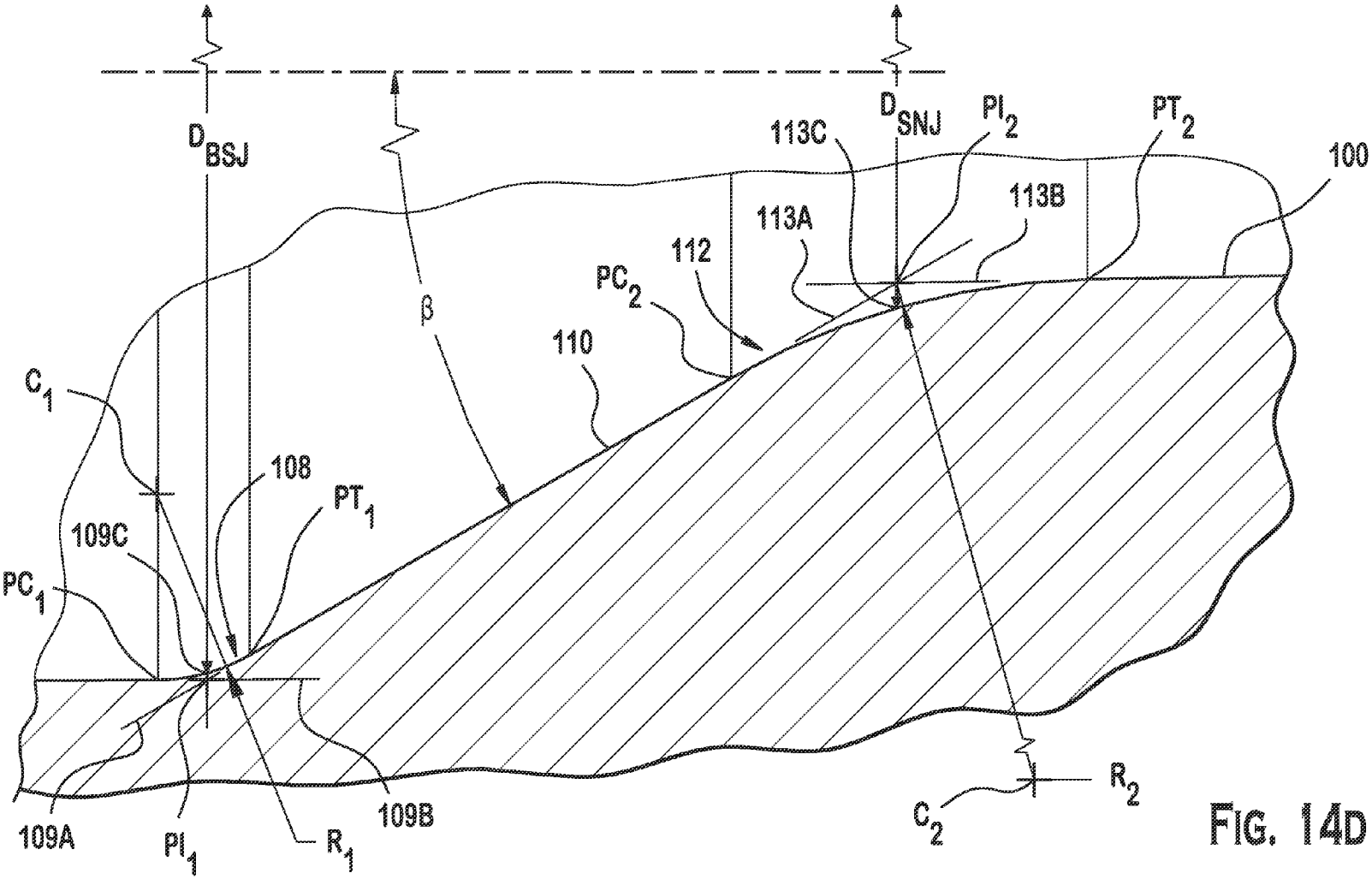
FIG. 14D is an expanded view of a portion of FIG. 14C.

Referring to FIG. 14D, the convex circular curve 112 may begin at a second point of curvature $PC_2$ and may end at a second point of tangency $PT_2$. The convex circular curve 112 may have a center point $C_2$ and a radius $R_2$. In this embodiment, the radius $R_2$ is approximately 0.1049 inches. The point of intersection $PI_2$ of the tangents 113A, 113B may define a second reference point. The point of intersection $PI_2$ may be spaced from the breech face 98 by an axial length $L_{PI2}$ (FIG. 14C). The point on the convex curve 112 that is spaced from the breech face 98 by a distance equal to the axial length $L_{PI2}$ may be a datum 113C for defining the headspace of the chamber. The diameter of the chamber at the datum 113C may be another reference dimension for the chamber. Namely, the headspace diameter $D_{SNJ}$ of the chamber. Referring to FIG. 14C, the datum also may define the end of the shoulder segment (or shoulder-neck junction ($S_{SNJ}$)) 106 of the chamber.

The neck segment 90 may begin at the shoulder neck junction ($S_{SNJ}$) 106 and continue through the point of tangency $PT_2$ to the neck-throat junction ($S_{NTJ}$) 148. The portion of the neck segment 90 extending from the point of tangency $PT_2$ to the neck-throat junction ($S_{NTJ}$) 148 may be linear, and thus the diameter of chamber at the neck-throat segment $D_{NTJ}$ may be constant along the linear portion of the neck segment 90.

The throat segment 92 may taper down from the neck-throat junction ($S_{NTJ}$) 148 to the throat-bore junction ($S_{TBJ}$) 150. In this embodiment, the axial length of the free bore $L_{FB}$ may be sufficiently short such that the bullet of the chambered cartridge may span the full axial length of the throat $L_{FB}$ and project into the bore 82. The bore 82 may have a diameter $D_B$ of 0.2320 inches. Preferably, the bore 82 may include rifling. The rifling may include 6 grooves that have a diameter $D_G$ of 0.2510 inches. The preferred rifling 156 may further exhibit a 1 in 9 twist. Measured dimensions for the chamber 80 are shown in FIG. 14 C and presented in TABLE 4 (below).

Figures 15, 16:
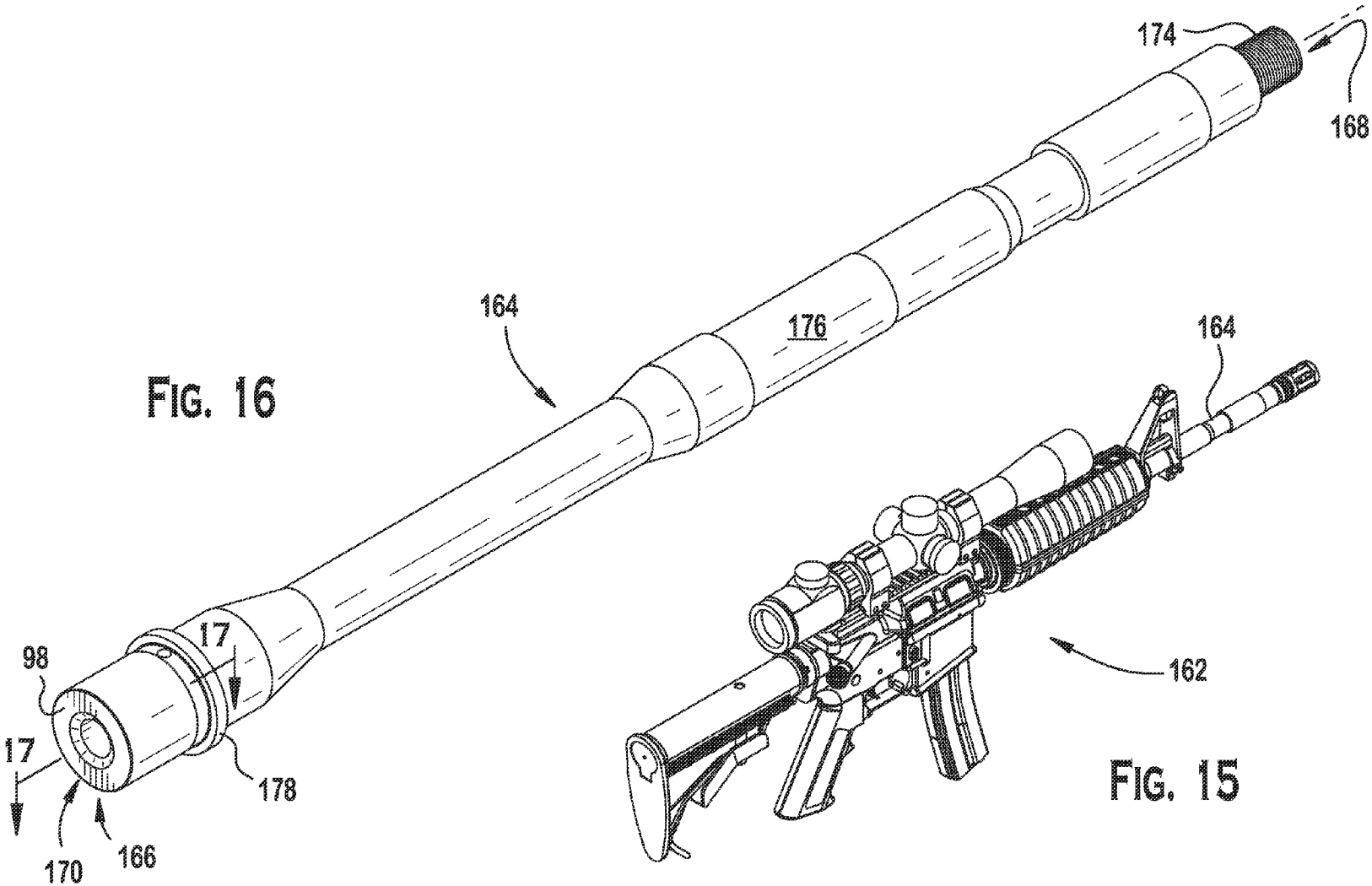
FIG. 15 is a perspective view of an exemplary embodiment of a long arm that is configured and chambered for the ammunition of FIGS. 1, 10 and 11.
FIG. 16 is a perspective view of the barrel of FIG. 15.

FIG. 15 depicts an AR-15 weapon platform 162 that is configured for 9 mm ammunition. The barrel 164 of the AR-15 weapon platform, however, may be chambered for the ammunition cartridge of FIGS. 1, 10, 11 and 12. The barrel 164 may be configured for straight blowback operation. The AR-15 weapon platform 162 may be capable of semi-automatic and full automatic modes.

TABLE 4

Measured Chamber Dimensions

| Description | Parameter | Measurement (a) |
|---|---|---|
| Length of axial distance from BF to $PI_1$ | $L_{PI1}$ | 0.4304 |
| Length of axial distance from BF to $PI_2$; (b) | $L_{PI2}$ | 0.5278 |
| Length of axial distance from BF to $S_{NTJ}$ | $L_{BFNTJ}$ | 0.7578 |
| Length of axial distance from BF to $S_{TBJ}$ | $L_{BFTBJ}$ | 0.7727 |
| Length of axial distance from $S_{NTJ}$ to $S_{TBJ}$ | $L_{FB}$ | 0.0149 |
| Diameter at base of chamber ($S_{CB}$) | $D_{CB}$ | 0.3765 |
| Diameter at base-shoulder junction ($S_{BSJ}$) | $D_{BSJ}$ | 0.3717 |
| Diameter at shoulder-neck junction ($S_{SNJ}$); (b) | $D_{SNJ}$ | 0.2596 |
| Diameter at neck-throat junction ($S_{NTJ}$) | $D_{NTJ}$ | 0.2510 |
| Diameter of bore | $D_B$ | 0.2320 |
| Diameter of rifling grooves | $D_G$ | 0.2510 |
| Radius of concave circular curve | $R_1$ | 0.0263 |
| Radius of convex circular curve | $R_2$ | 0.1049 |

Notes:
(a) Unless otherwise noted, unit dimensions measured in inches
(b) Headspace dimensions In general, the cycle of straight blowback operation may begin when the cartridge is fired. With an open-bolt cycle, the bolt may be held by the trigger sear to the rear and the recoil spring may be compressed. Pulling the trigger may release the sear; the action spring may then propel the bolt forward, which may strip a round from the feed system along the way. The bolt may carry the new cartridge into the chamber and at the end of its travel the firing pin may fire the primer and ignite the propellant. The pressure of expanding gases from the propellant may send the bullet down the barrel and at the same time may apply an opposite force to the cartridge case against the breech face of the bolt. The breech is kept sealed momentarily by the internal pressure of the cartridge case against the chamber and the inertia of the bolt. Then, momentum transferred to the case and bolt from the expanding gases moves the case and bolt to the rear. The momentum of the bolt is gradually transferred to the body of the gun and the shooter's body as the recoil spring is compressed. As the bolt travels back, the spent cartridge case is extracted and ejected, and the firing mechanism is cocked by the rearward travelling bolt. The bolt eventually reaches a velocity of zero and the kinetic energy from the recoil impulse is now stored in the compressed spring. The cycle repeats until the last round is expended or the trigger is released engaging the sear to hold the bolt in the rear (open-bolt) position.

Referring to FIG. 16, the barrel 164 may include a breech end 166 and a muzzle end 168. The breech end 166 may include a breech (i.e., a chamber opening) 170 and a surrounding breech face 98. Areas of the barrel 164 adjacent to muzzle end 168 may be threaded 174 for receiving a flash hider, compensator, suppressor, or other suitable tactical accessory or part. Although, the radial dimension of the barrel's exterior surface 176 may vary along the length of the barrel, the barrel's exterior surface may have generally constant radial dimension. Spaced from the breech end, however, may be a circumferential ring 178 that may be formed integrally with the barrel. The circumferential ring 178 may be a locking ring that may be used to secure the barrel 164 to an upper receiver of the firearm.

Figure 17:
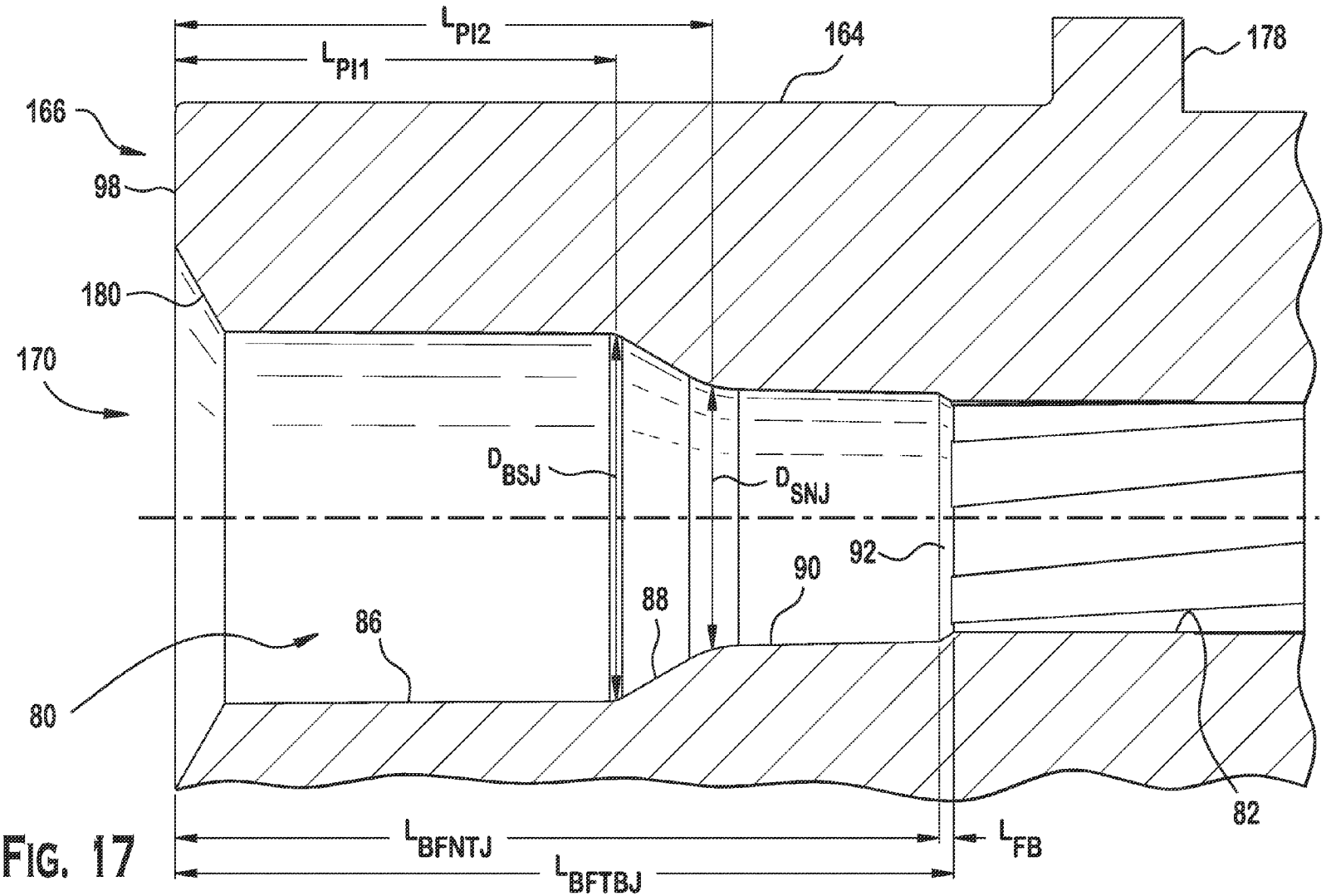
FIG. 17 shows a partial cross-section of the barrel of FIG. 16, along line 17-17.

Referring to FIG. 17, the barrel may include a breech face 98, a breech 170 that provides access to the barrel's chamber, a chamber 80, and a bore 82. The chamber 80 may be configured and dimensioned in accordance with FIG. 14C, and thus may include a profile that comprises a body segment 86, a shoulder segment 88, a neck segment 90, and a throat segment 92. The barrel 164, however, may include an optional tapered feed section 180 disposed between the breech face 98 and the body segment 86 of the chamber. The feed section 180 may facilitate loading of ammunition cartridges into the chamber due to the increased diameter of the feed section at the breech end.

Although the body segment 86 may be shorter in length than disclosed in FIG. 14C, the diameter $D_{BSJ}$ at the base-shoulder junction ($S_{BSJ}$) may be positioned at the same distance $L_{PI1}$ from the breech face. Similarly, the chamber 80 may have the same headspace dimensions (i.e., $L_{PI2}$ and $D_{SNJ}$) and shoulder geometry as disclosed in FIG. 14C. Additionally, the neck segment 90 and throat segment 92 may be configured and dimensioned within the barrel 164 as disclosed in FIG. 14C.

Figure 18:
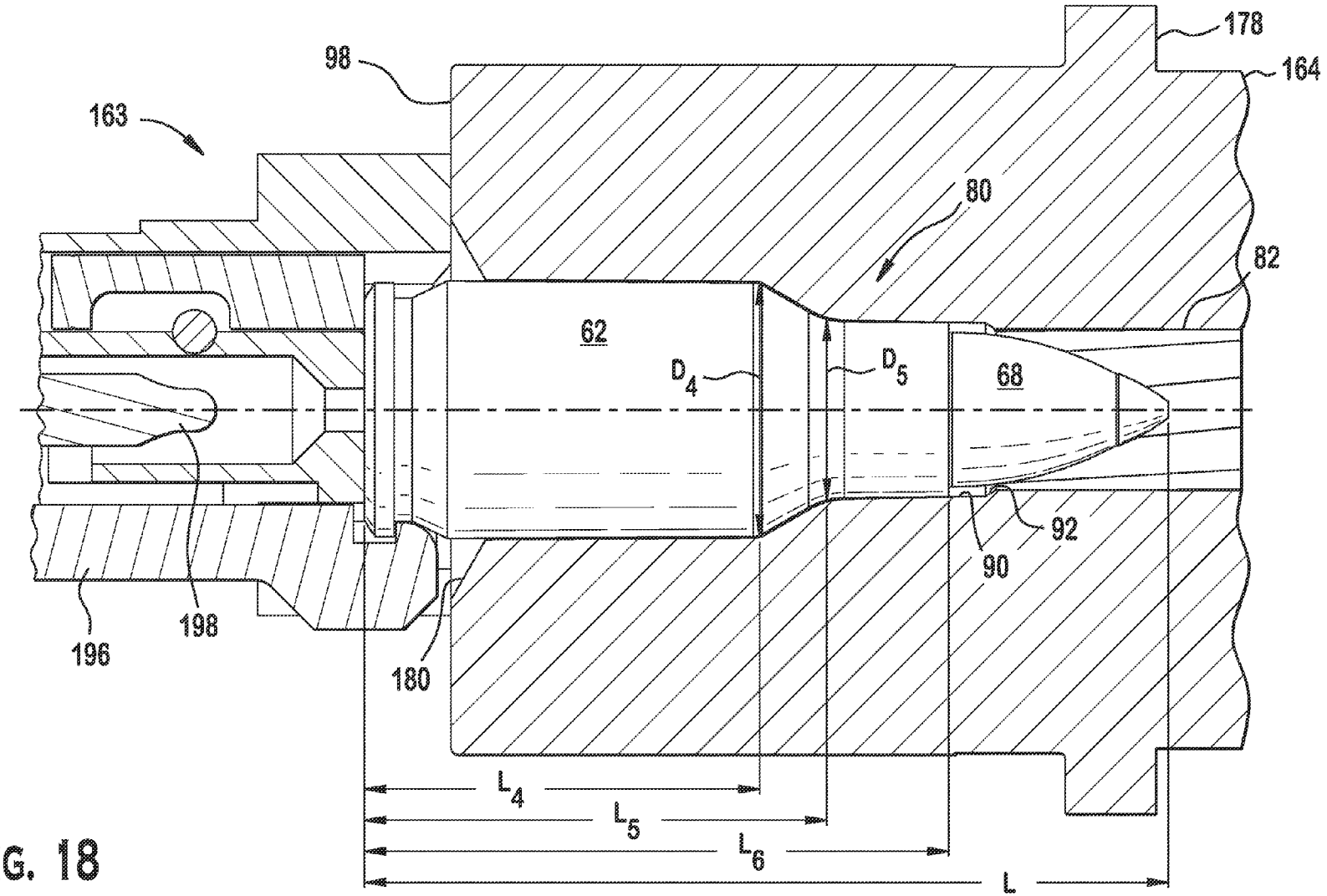
FIG. 18 is a cross-sectional view of the breech end of the barrel of FIG. 18, along with a chambered ammunition cartridge of FIG. 1.

FIG. 18 shows the barrel of FIG. 17 chambered with an exemplary ammunition cartridge 62, along with selected dimensions of the ammunition cartridge 62. For example, the axial length from the head face 40 to the base-shoulder junction $L_4$ is shown, along with the base-shoulder junction diameter D4. Additionally, the axial length from the head face 40 to the shoulder-neck junction (or headspace length) L5 of the cartridge is depicted, along with the diameter of the shoulder-neck junction (or headspace diameter) D5. The axial length of the case L6 is shown, as well as the total axial length L of the ammunition cartridge.

Generally, the ammunition cartridge 62 may fit into the chamber 80 with approximately 200,000$^{th}$ of an inch (0.002 inches) clearance. A clearance of approximately 0.002 inches between the unfired ammunition cartridge and the chamber may allow the case to be readily loaded into the chamber for firing, allow for proper sealing of the chamber by an expanded case during firing of the ammunition cartridge, and subsequent to firing of the ammunition cartridge may allow the case to contract sufficiently to facilitate extraction by the bolt group assembly.

Moreover, a generally consistent clearance between unfired ammunition cartridge cases and the chamber may facilitate safe and reliable operation of the firearm, as well as facilitate consistency of external ballistic parameters. Also, the bullet 68 may rest against the lands of the rifled bore when the ammunition cartridge is chambered. Further still, the bolt group assembly 163 may abut the barrel 164 and enclose the head 16 of the ammunition cartridge. This may indicate that the headspace of the cartridge is not too long for the chamber.

Generally, the barrel 164 may range in length from approximately 8 inches to approximately 20 inches, including standard barrel lengths of 10.5 inches, 14.5 inches, 16 inches, and 18 inches. Preferably, the barrel 164 may have a rifling of approximately one and nine twist. Although the barrel of FIG. 18 is configured for use with a 9 mm AR-15 platform, the barrel 164 may be configured for use in other long arms or hand guns.

Figures 19, 20:
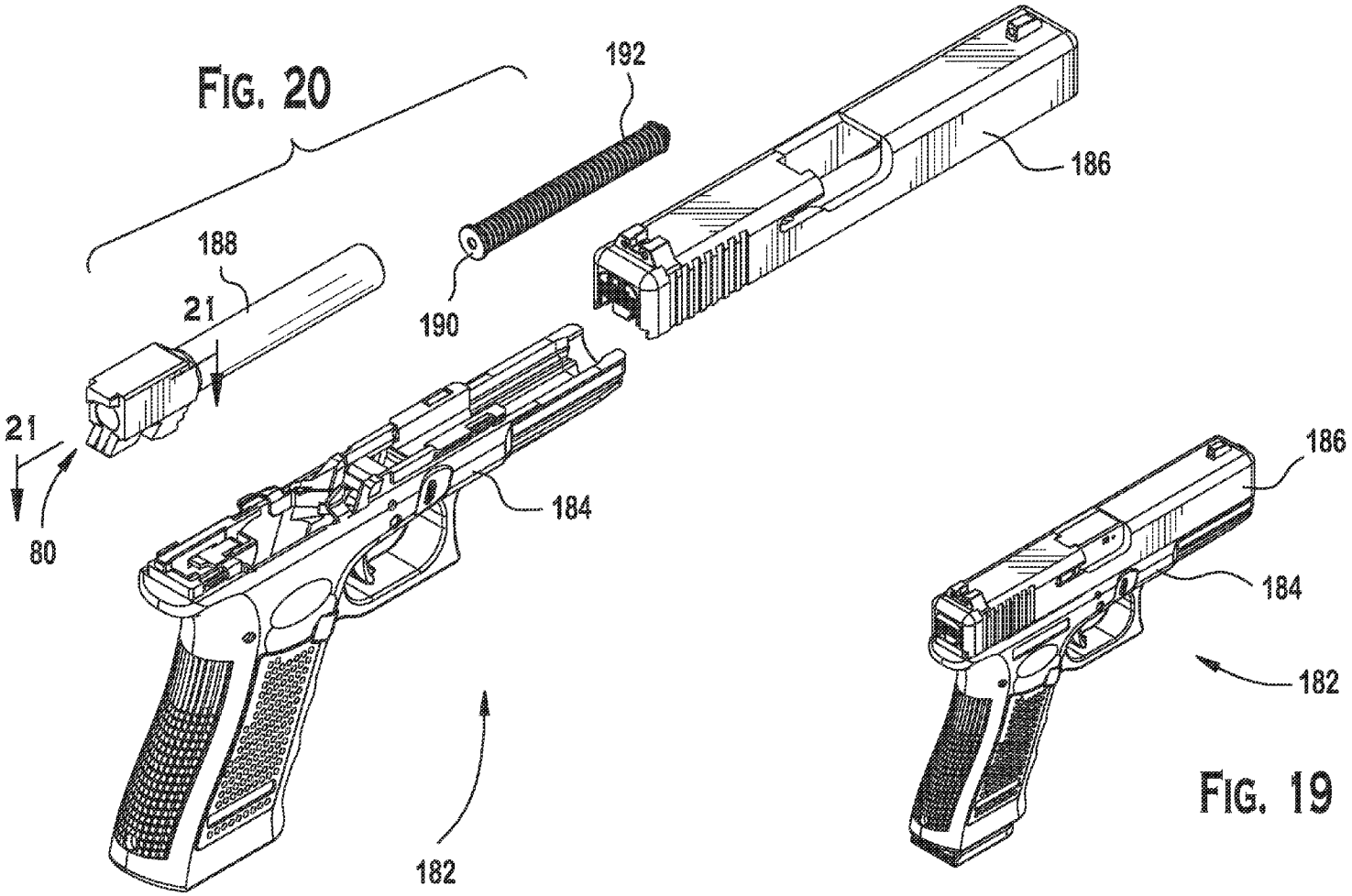
FIG. 19 is a perspective view of an exemplary embodiment of a pistol that is configured and chambered for the ammunition of FIGS. 1, 10 and 11.
FIG. 20 is a partially exploded view of the pistol of FIG. 19.

Referring to FIG. 19, a barrel that is chambered in accordance with FIG. 14C may be configured for use with a pistol 182. For instance, the pistol 182 may be a 9 mm Glock® 22. As shown in FIG. 20, the pistol 182 may include a frame 184, a slide 186, a barrel 188, a recoil spring guide rod 190, and a recoil spring 192. In this embodiment, the barrel 188 may be chambered in accordance with the chamber 80 of FIG. 14C. Although, the recoil spring 192 may be customized to accommodate the recoil of the ammunition cartridges of FIGS. 1, 10 and 11, the remaining components of the pistol 182 may be original manufacturer parts.

Figure 21:
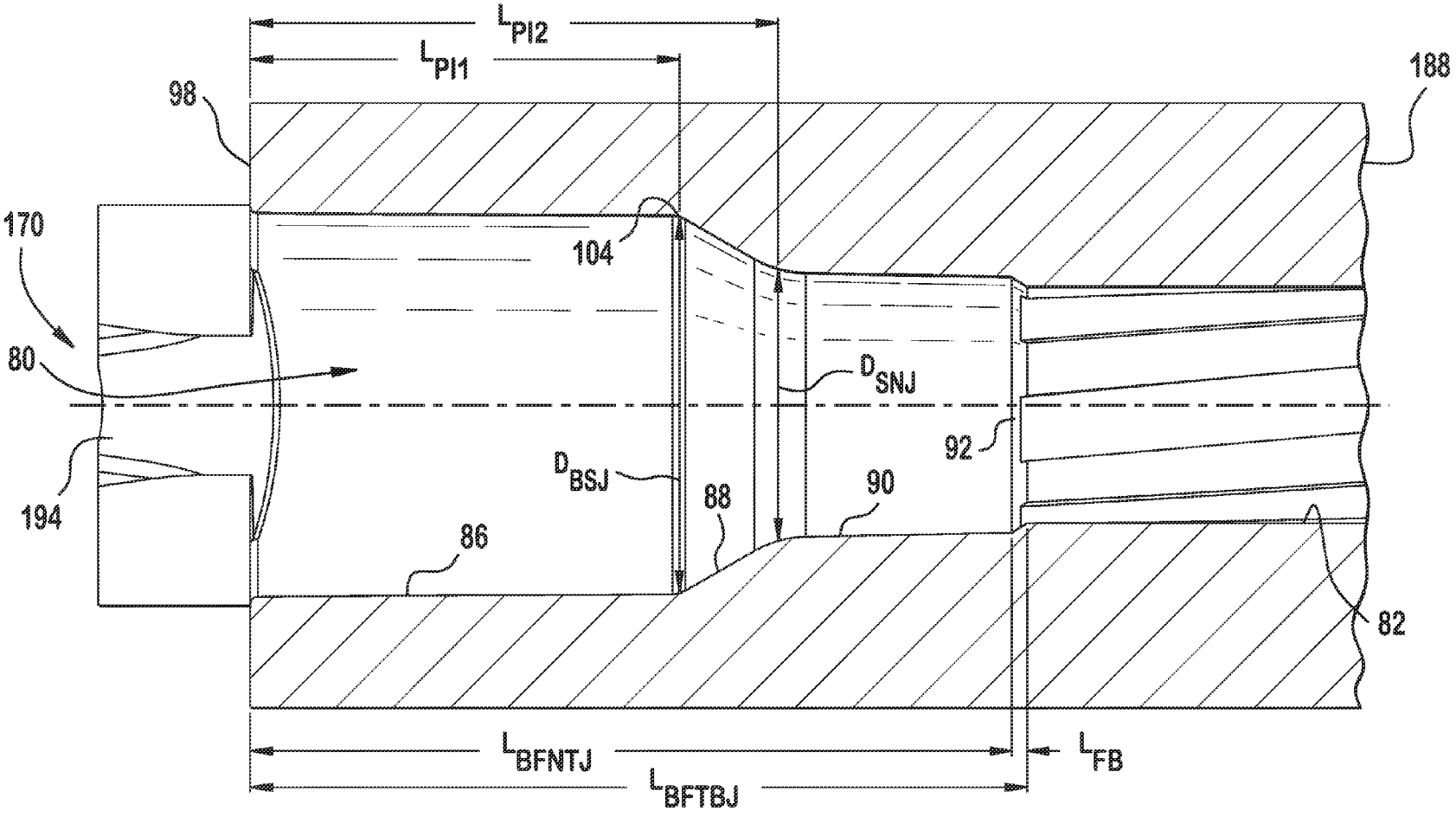
FIG. 21 shows a partial cross-section of the barrel of FIG. 20, along line 21-21.

Referring to FIG. 21, the barrel 188 may include a feed ramp 194, breech face 98, a breech 170 that provides access to the barrel's chamber, a chamber 80, and a bore 82. The feed ramp 194 may facilitate loading of ammunition cartridges into the chamber. The chamber 80 may be configured and dimensioned in accordance with FIG. 14C, and thus may include a profile that includes a body segment 86, a shoulder segment 88, a neck segment 90, and a throat segment 92. Hence, the base-shoulder junction ($S_{BSJ}$) 104 may be positioned at the same distance $L_{PI1}$ from the breech face 98 and may include the same diameter $D_{BSJ}$ as the chamber shown in FIG. 14C. Similarly, the chamber 80 may have the same headspace dimensions (i.e., $L_{PI2}$ and $D_{SNJ}$) and shoulder geometry as disclosed in FIG. 14C. Additionally, the neck segment 90 and throat segment 92 may be configured and dimensioned within the barrel 188 as disclosed in FIG. 14C.

Figure 22:
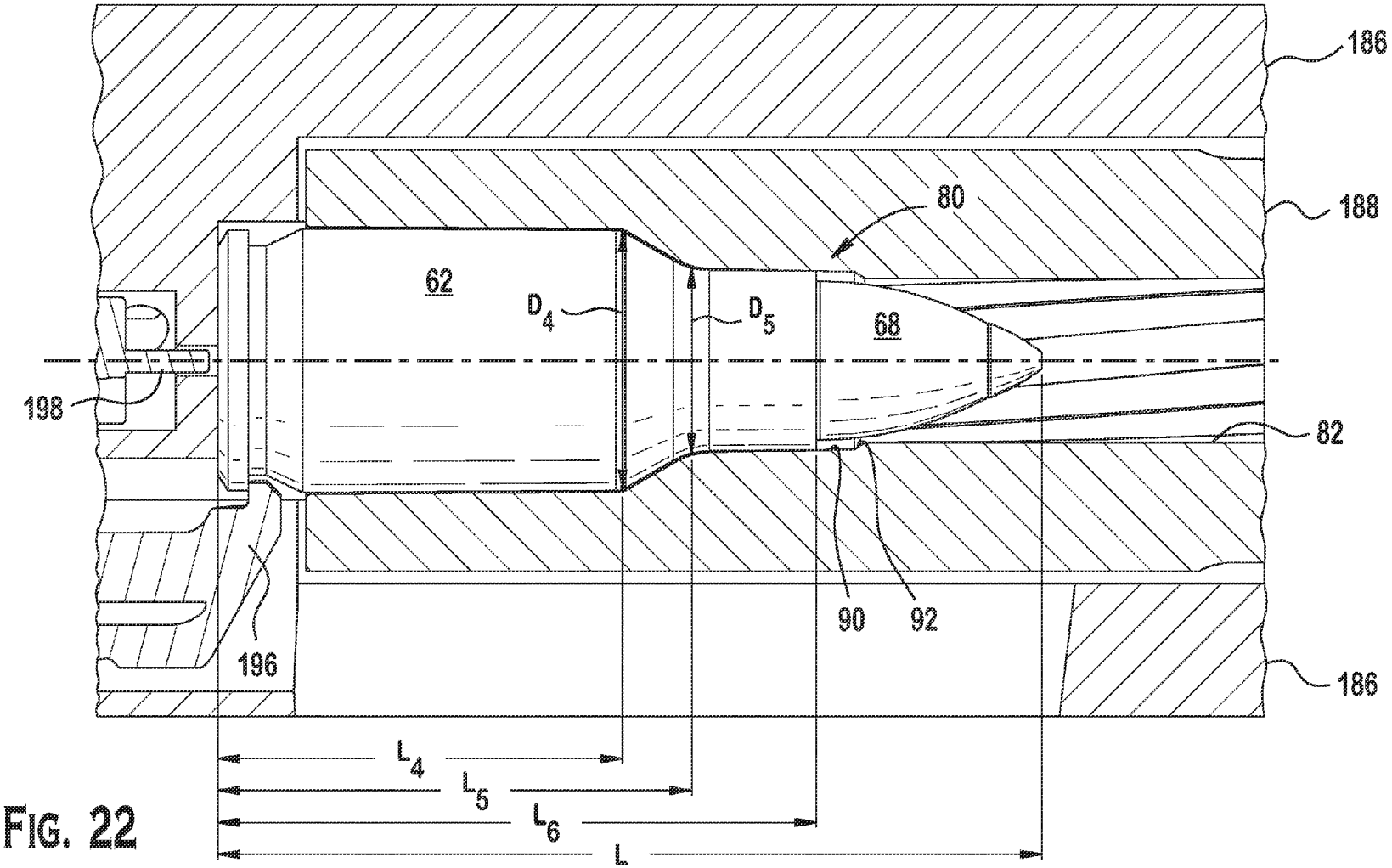
FIG. 22 is a cross-sectional view of the breech end of the barrel of FIG. 20, along with a chambered ammunition cartridge of FIG. 1.

FIG. 22 shows the barrel 188 of FIG. 21 chambered with an ammunition cartridge of FIG. 1. The barrel 188 may be positioned within the slide 186, the extractor 196 may be interlocked with the head 16 of the ammunition cartridge, and the firing pin 198 may be adjacent to the primer pocket 48. Reference dimensions of the ammunition cartridge 62 are indicated on the drawing. For example, the axial length measured from the head face 40 to the base-shoulder junction L4 of the cartridge, as well as the base-shoulder junction diameter D4 are shown. Additionally, the axial length from the head face 40 to the shoulder-neck junction (or headspace length) L5 of the cartridge, as well as the diameter of the shoulder-neck junction (or headspace diameter) D5 are shown. Moreover, the case length (or axial length measured from the head face 40 to the mouth 18) L6 is shown. The total length L of the ammunition cartridge is also depicted.

Generally, the ammunition cartridge 62 may fit into the chamber 80 with approximately 200,000$^{th}$ of an inch (0.002 inches) clearance. A clearance of approximately 0.002 inches between the unfired ammunition cartridge 62 and the chamber 80 may allow the case to be readily loaded into the chamber for firing, allow for proper sealing of the chamber by an expanded case during firing of the ammunition cartridge, and subsequent to firing of the ammunition cartridge may allow the case to contract sufficiently to facilitate extraction by the bolt group assembly. Moreover, a generally consistent clearance between unfired ammunition cartridge cases and the chamber may facilitate safe and reliable operation of the firearm, as well as facilitate consistency of external ballistic parameters. Also, the bullet 68 may rest against the lands of the rifled bore when the ammunition cartridge is chambered. Further still, the bolt group assembly may abut the barrel and enclose the head of the ammunition cartridge. This is an indication that the headspace of the cartridge is not too long for the chamber.

Generally, the pistol barrel 188 may range in length from approximately 3 inches to approximately 8 inches, including standard barrel lengths of 3.77 inches, 4.00 inches, 4.50 inches, and 5.00 inches, and 6.80 inches. Preferably, the barrel 188 may have a rifling of approximately one and nine twist. Although the barrel 188 may be configured for use with a 9 mm Glock® 22 platform, other barrels may be configured for use in different pistols. For instance, without limitation, the barrel 188 and spring 192 may be adapted for use in a Colt 1911 pistol.

Preferably, the barrels 164, 188 of FIGS. 21 and 22 may be formed from barrel steel. For example, chrome molybdenum steel (e.g., 4140, 4150 and 4340), chrome moly vanadium steel (e.g., 4150V), or stainless steel (e.g., 416R). The barrel steel may adhere to Military Specification (Mil-B-11595) dated Jun. 7, 1998 for Bar, Metal, and Blanks (under 2 inches in diameter) for Barrels of Small Arms Weapons. Other suitable barrel materials also may be used. The barrels may include a coating. For example, the barrels may include, without limitation, a nitride coating or a phosphate coating.

Figure 25:
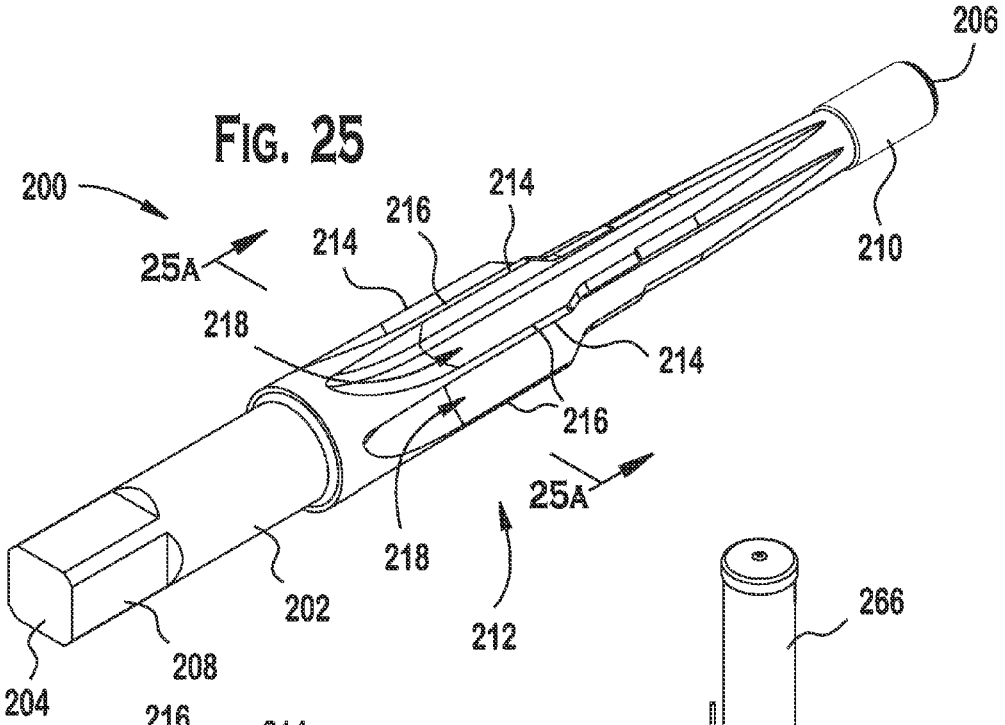
FIG. 25 presents a perspective view of the reamer of FIG. 23.
Figure 25A:
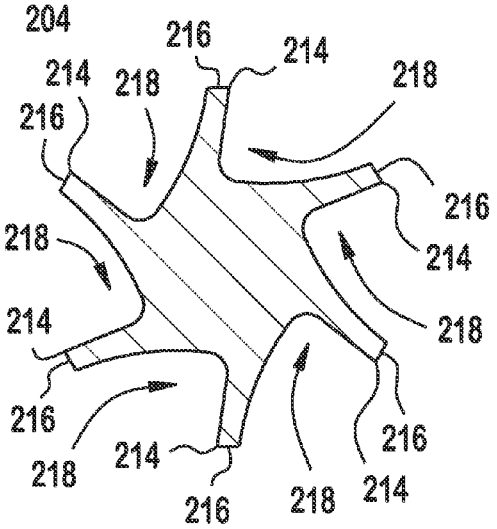
FIG. 25A is a cross-sectional view of the reamer of FIG. 25, along line 25A-25A.

FIG. 25 depicts an exemplary embodiment of a chamber reamer 200 for forming the chamber 80 of FIG. 14 in a barrel blank. The chamber reamer 200 also may be used to form interior working surfaces of reloading dies (see e.g., FIGS. 26-32). The chamber reamer 200 may include a shank 202 that includes a proximal end 204 and a distal end 206. The proximal end 204 may include a tang 208 for securing the shank 202 to a powered cutting tool (e.g. a lathe). The distal end 206 may include a pilot 210 that may be sized for the bore 82 of the barrel and which may guide the chamber reamer 200 as it is advanced into the barrel blank. The chamber reamer 200 may include a cylindrical body 212 between the tang 208 and the pilot 210 that includes a set of generally parallel cutting edges 214. Referring to FIG. 25A, each cutting edge 216 may include a land 216 and flute 218. In the exemplary embodiment, the chamber reamer 200 includes six cutting edges 214.

Figures 23, 24:
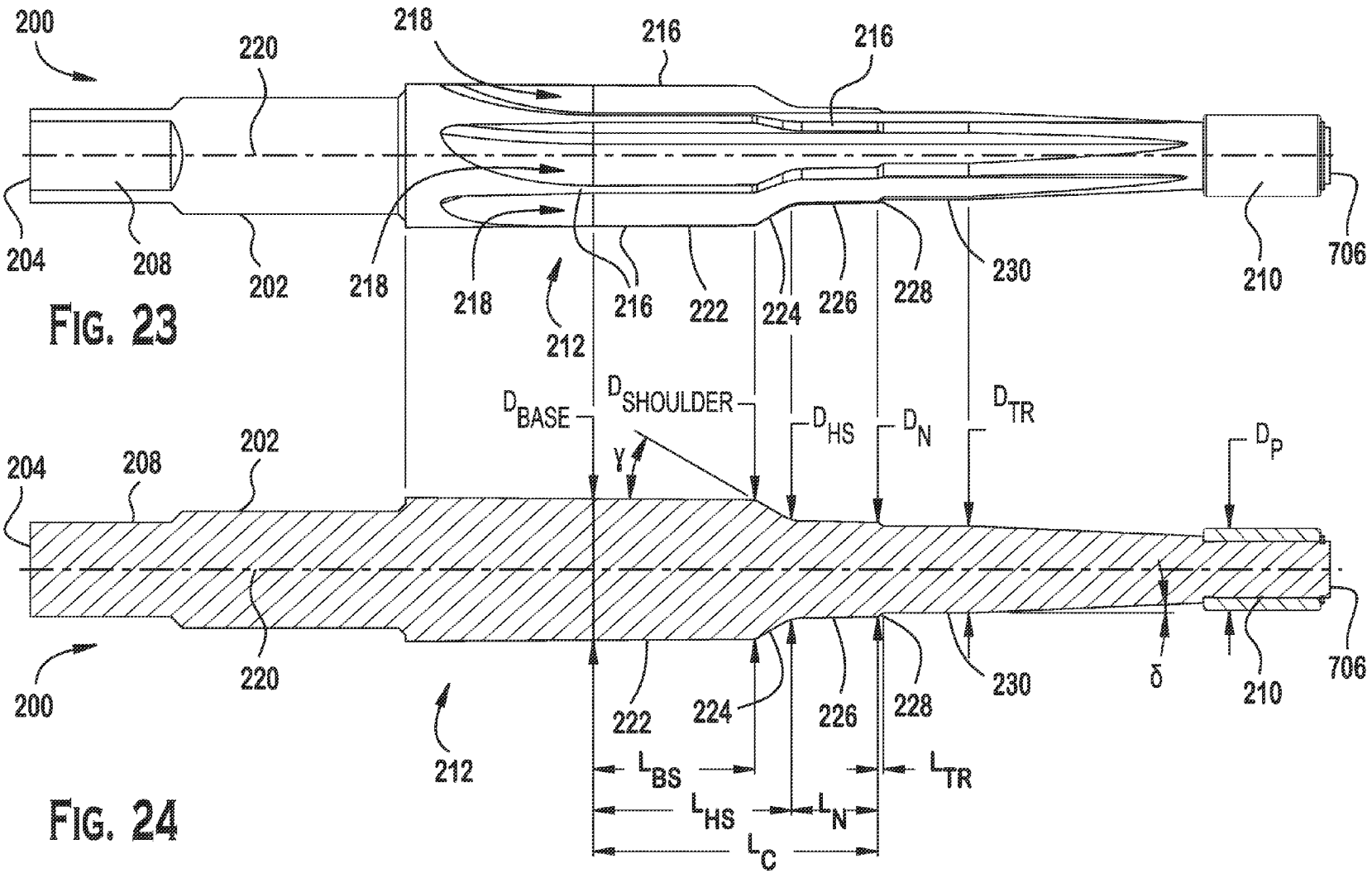
FIG. 23 is a side view of an exemplary embodiment of a reamer which may be used to form a chamber which is configured and dimensioned for firing ammunition cartridges that utilize the case of the present invention.
FIG. 24 is a cross-sectional view of the reamer of FIG. 23.

Referring to FIG. 23, the chamber reamer 200 may have a central axis 220 and the cylindrical body 212 may taper in diameter from the shank 202 to the pilot 210. The chamber reamer 200 may include a base section 222 which includes an outer profile that generally corresponds to the outer diameter of the body 26 of the case of FIG. 9. The chamber reamer 200 may also include a shoulder section 224, a neck section 226, a throat section 228, and a bore section 230. Each of these sections may generally correspond to the profile of the respective part of the chamber 80 of FIG. 14C.

As shown in FIG. 24, the chamber reamer may include a minimum chamber length $L_c$, a base-to-shoulder section length $L_{BS}$, a neck section length $L_n$, and a throat section length $L_{tr}$. The chamber reamer 200 may further include a base diameter $D_{base}$, a shoulder diameter $D_{shoulder}$, a headspace diameter $D_{HS}$, a neck diameter $D_n$, a throat diameter $D_{TR}$, and a pilot diameter $D_p$. Also, the shoulder section 224 of the reamer 200 may form a shoulder angle γ and the section between the throat section 228 and the pilot section 230 may form a taper angle δ. Table 5 (below) presents exemplary values for a finishing reamer for the chamber of FIG. 14C.

The chamber reamers may be formed from high speed steel (e.g., HSS, M1, M2, M7, M50), cobalt alloys (e.g., M-35, M-42), tungsten carbide, and other suitable metal alloys.

TABLE 5

Finishing Reamer Dimensions

| Description | Parameter | Value (a) |
|---|---|---|
| Minimum chamber length | $L_c$ | .7578 |
| Base to body-shoulder junction section length (b) | $L_{BS}$ | .4304 |
| Base to shoulder-neck junction section length (b) | $L_{HS}$ | .5278 |
| Neck section length | $L_N$ | .2300 |

TABLE 5-continued

Finishing Reamer Dimensions

| Description | Parameter | Value (a) |
|---|---|---|
| Throat section length | $L_{TR}$ | .0149 |
| Base diameter | $D_{Base}$ | .3765 |
| Shoulder diameter | $D_{shoulder}$ | .3717 |
| Headspace diameter | $D_{HS}$ | .2596 |
| Neck diameter | $D_N$ | .2510 |
| Throat diameter | $D_{TR}$ | .2320 |
| Pilot diameter | $D_P$ | .2180 |
| Shoulder angle | γ | 29.8970° |
| Taper angle | δ | 2.5° |

Notes:
(a) Unless otherwise noted, unit dimensions measured in inches
(b) Dimensions are to intersection of tangent lines Preferably, a finishing reamer is sized to cut a chamber to the appropriate final dimensions, which are the correct size to meet specifications for a specific cartridge type. Sometimes, a roughing reamer may be used to make an initial cut in the work piece being chambered. Generally, roughing reamers may be used in production environments when a large number of chambers will need to be cut in an effort to avoid wear on the finishing reamer. The roughing reamer may be undersized with respect to the finishing reamer. For example, a roughing reamer may be approximately 0.002" smaller (radially) overall than the finishing reamer. Additionally, the roughing reamer may be used to chamber sizing dies for the specific cartridge type that the finishing reamer is dimensioned for. Table 6 (below) presents exemplary values a roughing reamer for the chamber of FIG. 14C.

TABLE 6

Roughing Reamer Dimensions

| Description | Parameter | Value (a) |
|---|---|---|
| Minimum chamber length | $L_c$ | .7578 |
| Base to body-shoulder junction section length (b) | $L_{BS}$ | .4304 |
| Base to shoulder-neck junction section length (b) | $L_{HS}$ | .5278 |
| Neck section length | $L_N$ | .2300 |
| Throat section length | $L_{TR}$ | .0149 |
| Base diameter | $D_{Base}$ | .3745 |
| Shoulder diameter | $D_{shoulder}$ | .3697 |
| Headspace diameter | $D_{HS}$ | .2576 |
| Neck diameter | $D_N$ | .2490 |
| Throat diameter | $D_{TR}$ | .2300 |
| Pilot diameter | $D_P$ | .2180 |
| Shoulder angle | γ | 29.8970° |
| Taper angle | δ | 2.5° |

Figure 26:
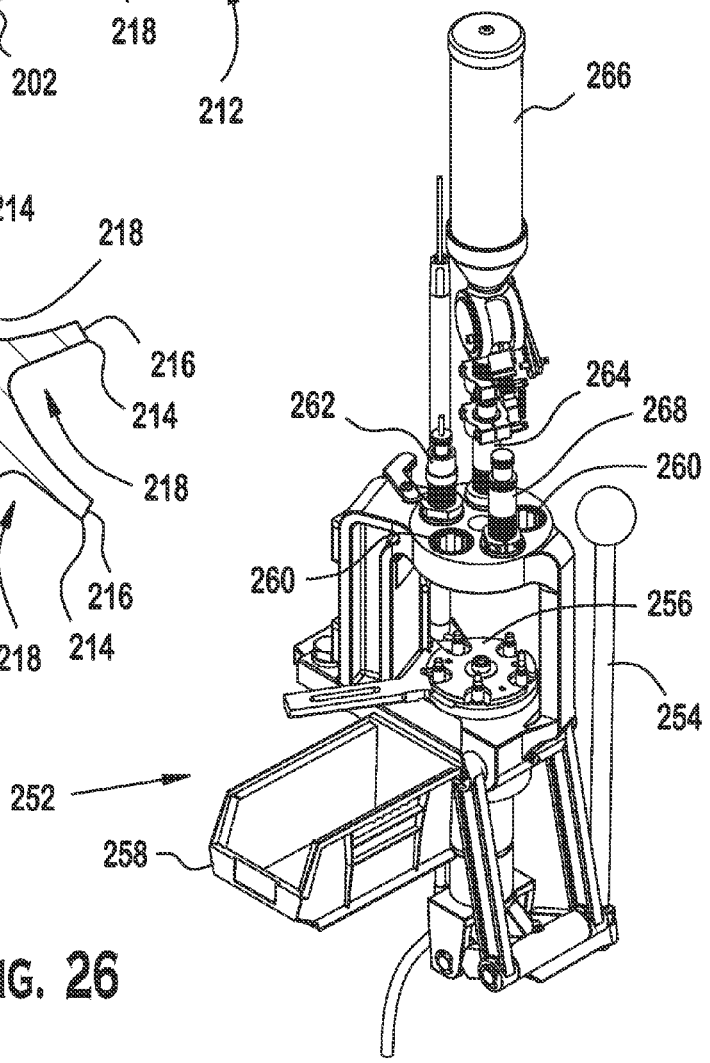
FIG. 26 is a perspective view of an exemplary press for reloading ammunition cartridges.

Notes:
(a) Unless otherwise noted, unit dimensions measured in inches
(b) Dimensions are to intersection of tangent lines FIG. 26 presents an exemplary 5-station progressive press 252 for reshaping and reloading ammunition cases. The press 252 may include a handle 254, shell plate 256, cartridge catcher 258, and five bushings 260. A sizing die 262 may be received in one bushing 260, and a powder die 264 that may include a powder measure 266 may be disposed in an adjacent bushing 260. The press may also include a seating die 268 in another bushing 260.

Figure 27:
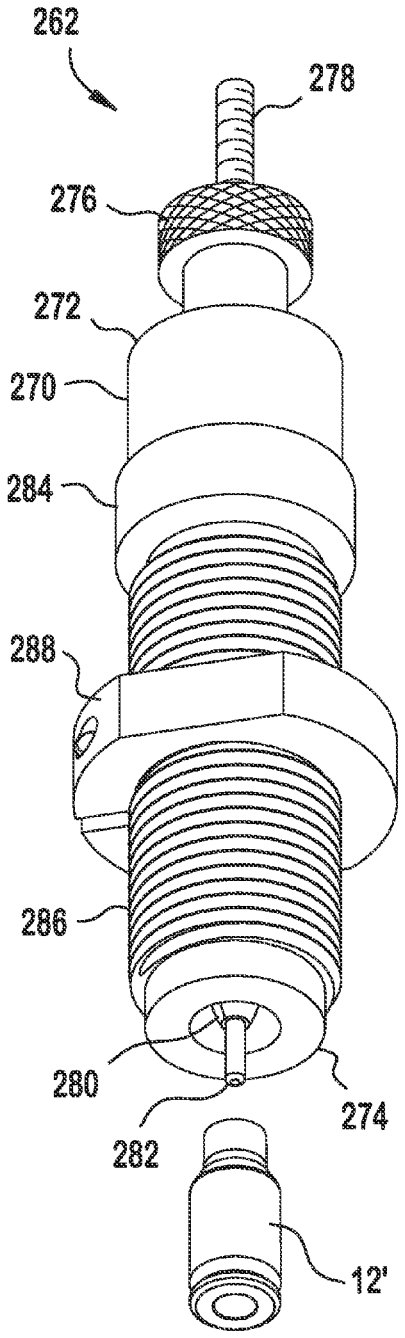
FIG. 27 is a perspective view of an exemplary embodiment of a sizing die for reloading ammunition cartridges that utilize the case of FIG. 3.

Referring to FIG. 27, the sizing die 262 may include a cylinder 270 having an upper end 272 and a lower end 274. Additionally, the sizing die 262 may include a spindle adjust 276 and a spindle 278. The lower end of the spindle 278 may further include an expander 280 and a decap pin 282. The lower end 274 of the sizing die 262 may be configured and dimensioned to receive an intact but fired case 12' of the ammunition cartridges of FIG. 1, 10 or 11. The fired case 12' may include a spent primer 50'. The exterior surface of the sizing die 262 may include a collar portion 284. The collar portion 284 may be located closer to the upper end 272 than to the lower end 274. The exterior surface of the sizing die 262 below the collar portion may include a threaded segment 286. A lock ring 288 having mating internal screw threads 290 may be secured to the threaded segment 286.

Figure 28:
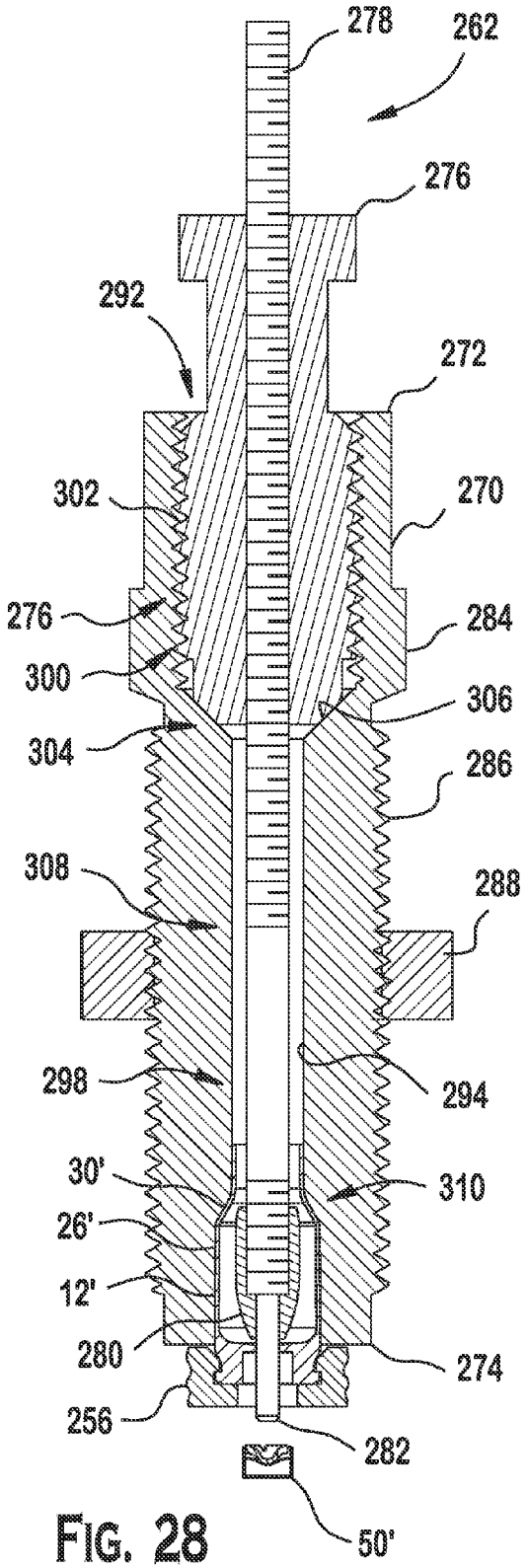
FIG. 28 is a cross-sectional view of the sizing die of FIG. 27, along line 28-28.

Referring to FIG. 28, the cylinder 270 may include a central bore 292 that extends from the upper end 272 to the lower end 274. The central bore 292 may be defined by an inner sidewall 294. An upper portion 296 of the central bore may have greater diameter than a lower portion 298 of the central bore. An upper inner sidewall segment 300 may include internal screw threads 302. An intermediate inner side wall segment 304 may include a tapered portion 306 that connects the upper inner side wall segment 300 to a lower inner side wall segment 308. The lower inner side wall segment 308 may include a resizing segment 310. The resizing segment 310 may be configured and dimensioned to correspond to the profile of the chamber 80 of FIG. 14C. In use, the sizing die 262 may be pressed down on to a fired ammunition case 12' that has been loaded on to the shell plate 256 of the reloading press 252. The expander 280 may press the neck of the fired ammunition case 12' against the resizing segment 310. The resizing segment 310 may press the shoulder 30' and body 26' of the case 12' into a pre-firing configuration 12 as generally shown in FIG. 9A. The decap pin 282 may press the spent primer 50' out of the primer pocket 48'.

Figure 29:
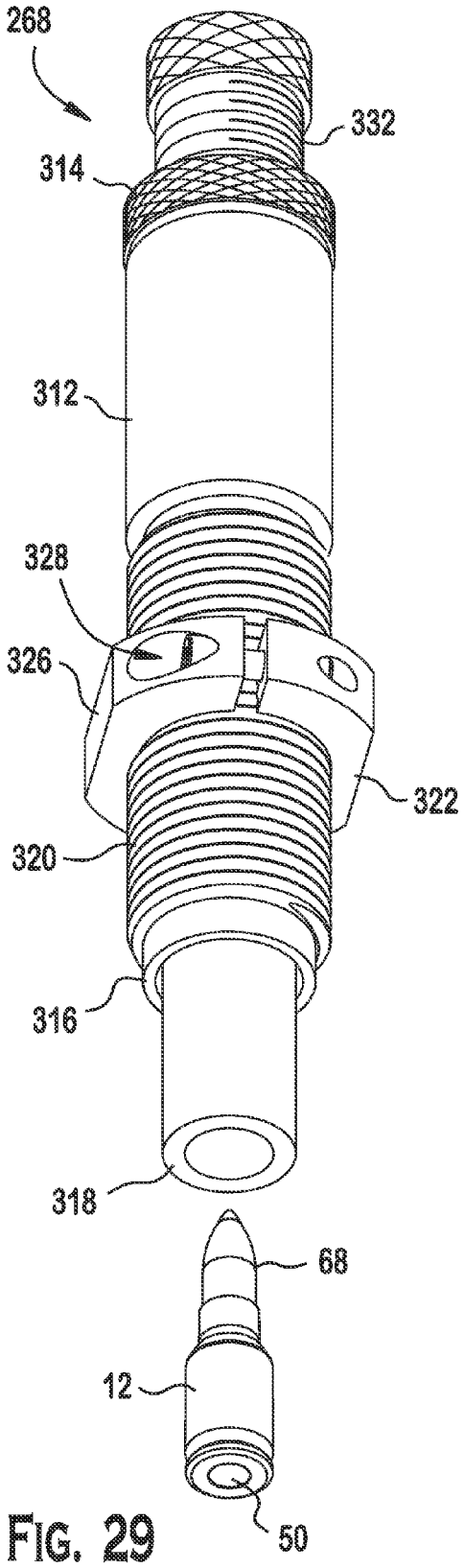
FIG. 29 is a perspective view of an exemplary embodiment of a seating die for reloading ammunition cartridges that utilize the case of FIG. 3, the seating die being in an extended configuration.
Figure 30:
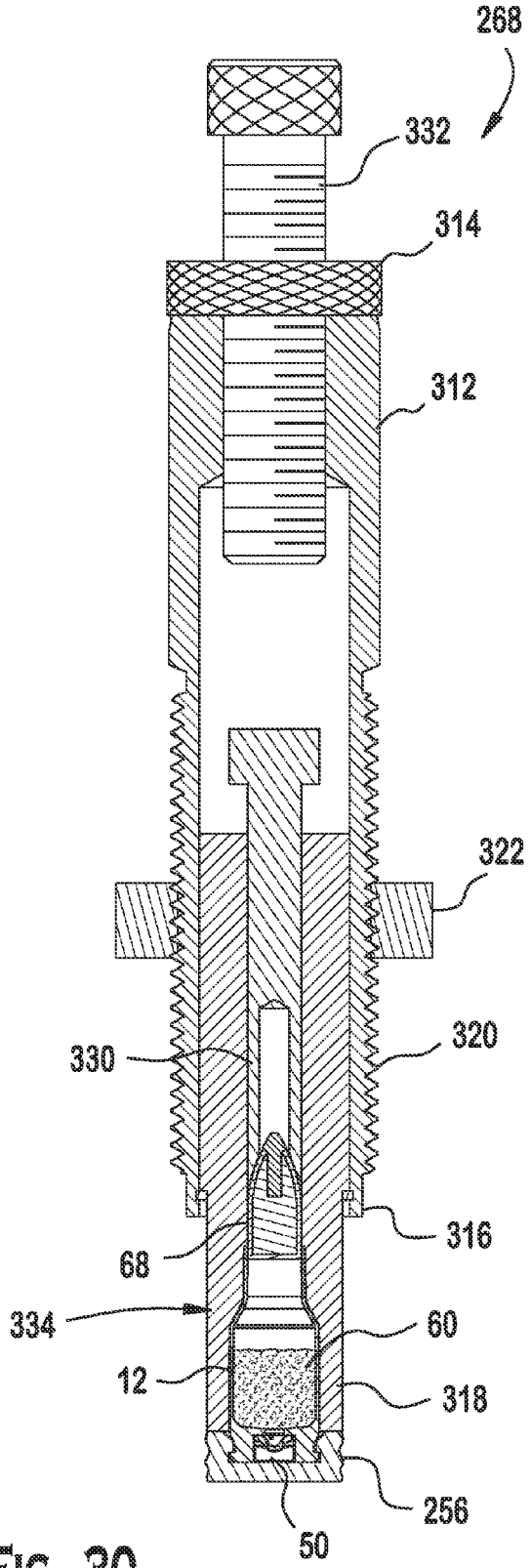
FIG. 30 is a cross-sectional view of the seating die of FIG. 29, along line 30-30.
Figure 31:
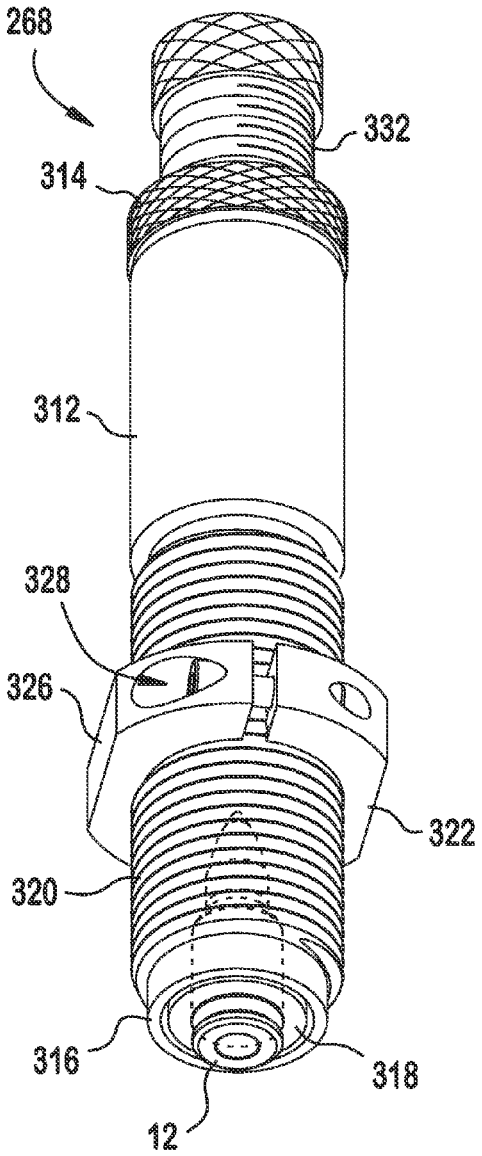
FIG. 31 is another perspective view of the seating die of FIG. 29, the seating die being in a retracted configuration.

Referring to FIG. 29 and FIG. 31, the seating die 268 may include an elongated member 312 having an upper end 314 and a lower end 316. The lower end 316 may include a telescoping seating stem 318. The telescoping seating stem 318 may be configured and dimensioned to receive a reformed and loaded ammunition case 12 and bullet 68. The lower exterior portion of the elongated member 312 may be threaded 320. A lock ring 322 with mating internal threads 324 may be secured to the exterior screw threads 320. The lock ring 322 may further include a wrench flat 326 and a locking mechanism 328 for fixing the position of the lock ring 322 to the elongated member 312.

Figure 32:
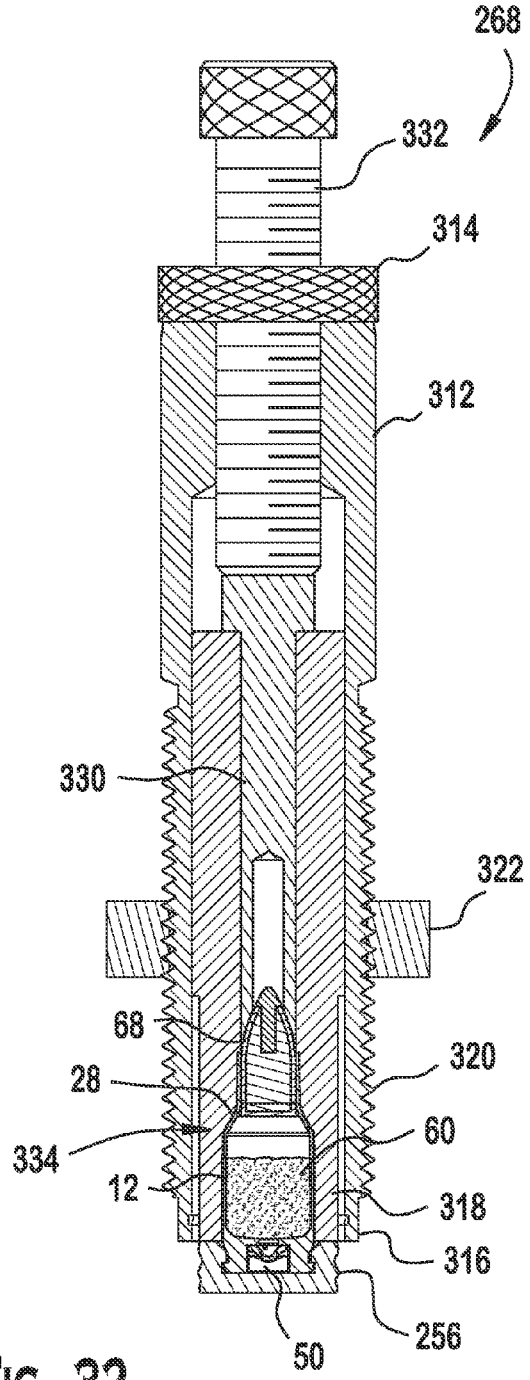
FIG. 32 is a cross-sectional view of the seating die of FIG. 31, along line 31-31.

Referring to FIG. 31 and FIG. 32, the seating die 268 may further include a floating bullet seating stem 330, and a bullet seat adjustment screw 332. The lower end of the telescoping seating stem 330 may include a bullet seating segment 334. The bullet seating segment 334 may be configured and dimensioned to correspond to the profile of the chamber 80 of FIG. 14C. The seating die 268 may be pressed down on a bullet 68 and a reformed case 12 that has been re-primed 50 and charged with propellant 60. As shown in FIG. 32, the floating bullet seating sleeve 330 may position the bullet 68 at a desired and preset depth in the neck 28 of the case 12, as the bullet seating segment 332 squeezes the neck 28 of the case 12 to securely retain the bullet 68.

Figure 33:
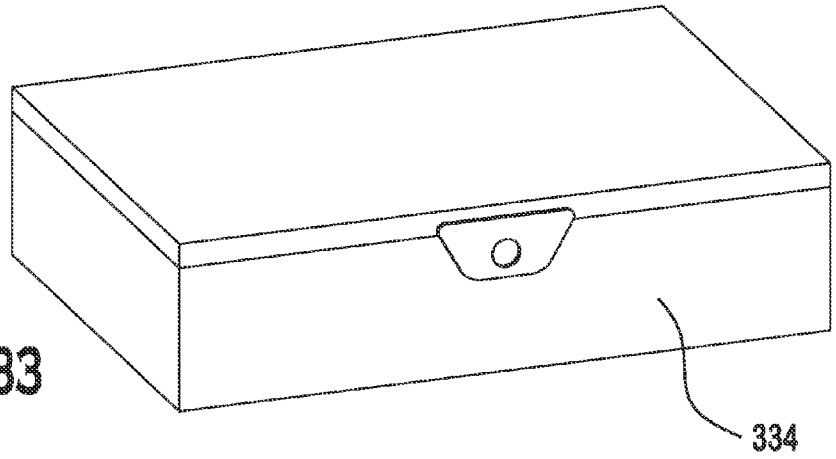
FIG. 33 is a perspective view of a storage box for a reloading die kit in a closed configuration.
Figure 34:
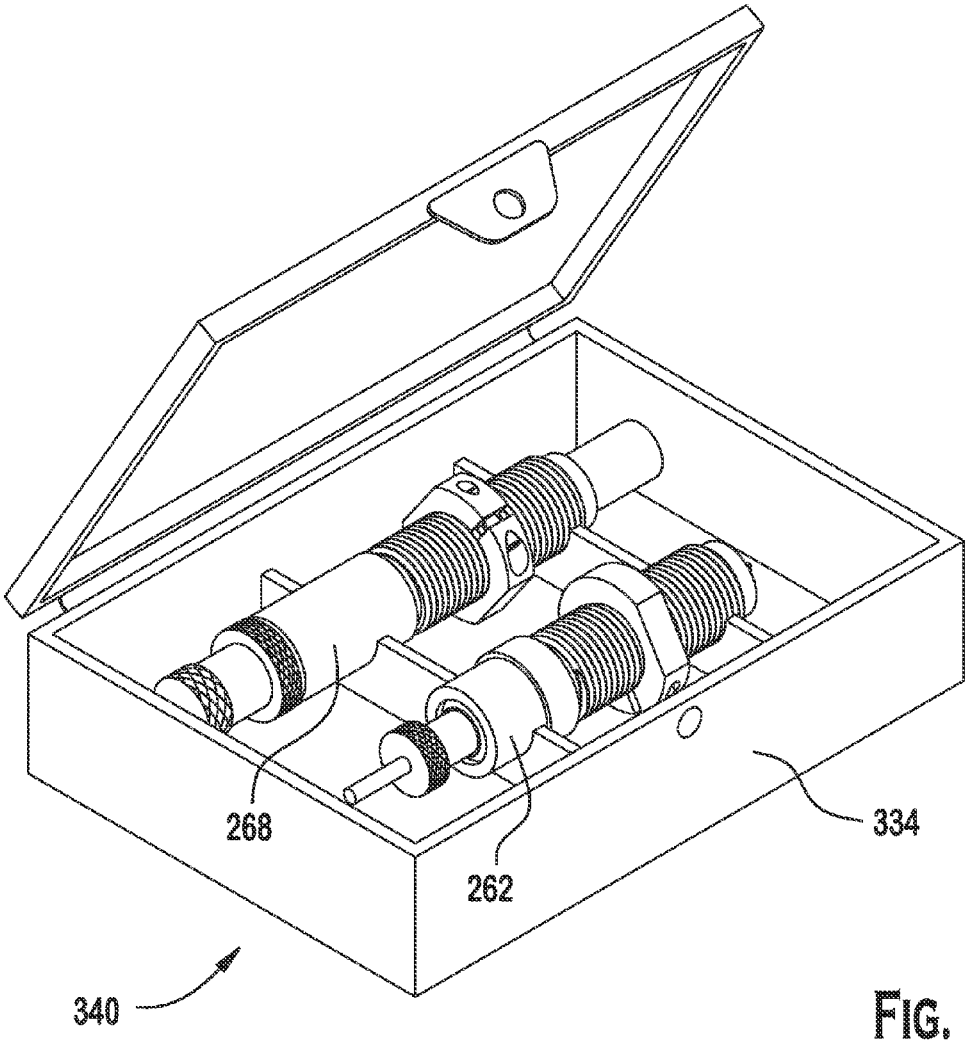
FIG. 34 is a perspective view of the storage box of FIG. 33 in an open configuration.

FIG. 33 shows a die storage box 334 for storing ammunition cartridge reloading dies (e.g., 262, 268). The die storage box may be formed from cardboard, plastic, a polymer material or other suitable material. Other tools may be stored in the die storage box as well. For example, associated shell holders 336 and bushings 338 also may be stored in the die storage box 334. As shown, in FIG. 34, the die storage box 334 may include receptacles for holding two ammunition cartridge reloading dies. In FIG. 34, one reloading die is the sizing die 262 of FIGS. 26-28, and the other reloading die is the seating die of FIGS. 26, 29, 30, 31 and 32. The die storage box 334, the sizing die 262, and the seating die 268 may be packaged as a kit 340.

While it has been illustrated and described what at present are considered to be a preferred embodiment of the present invention, it will be understood by those skilled in the art that various changes and modifications may be made, and equivalents may be substituted for elements thereof without departing from the true scope of the invention. For example, the case may be used with other bullets, such as bullets with different configurations or nontraditional cores, as well as with different propellant. Also, different charges of propellant may be used. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A case for an ammunition cartridge comprising:

a tubular member having a central axis which comprises a head which comprises a head face which is disposed substantially perpendicular to the central axis, and an extraction groove adjacent to the head face, the extraction groove circumscribing the central axis, a body abutting the head which comprises an internal chamber, a bullet receiving end spaced from the body along the central axis, a convex curved segment abutting the body, the convex curved segment being a first circular curve having a first radius of approximately 0.0263 inches, a frusto-conical segment abutting the convex curved segment, and a concave curved segment abutting the frusto-conical segment, the concave curved segment being a second circular curve having a second radius of approximately 0.1049 inches, wherein the concave curved segment comprises a shoulder-neck junction, the shoulder-neck junction being spaced from the head face along the central axis by approximately 0.6673 inches, wherein the tubular member at the shoulder-neck junction comprises a first reference outer diameter of approximately 0.2626 inches, wherein the tubular member has an axial length that is measured along the central axis from the head face to the bullet receiving end, and the axial length of the tubular member is substantially equal to or less than 0.8461 inches, wherein the convex curved segment comprises a body-shoulder junction, the body-shoulder junction being spaced from the head face along the central axis by approximately 0.5699 inches, and wherein the tubular member at the body-shoulder junction comprises a second reference outer diameter of approximately 0.3676 inches.

2. The case of claim 1, wherein the bullet receiving end comprises an outer diameter of approximately 0.2489 inches.

3. The case of claim 2, wherein the bullet receiving end comprises a mouth of a passage that extends along the central axis to the internal chamber, the mouth having an inner diameter of approximately 0.2211 inches.

4. The case of claim 1, wherein the head further comprises
a rim abutting the extraction groove, and
an opening on the head face, the opening extending toward the body and forming a pocket in the head.

5. The case of claim 4, wherein the body further comprises a flash hole connecting the pocket and the internal chamber.

6. The case of claim 5, wherein the flash hole comprises a diameter of approximately 0.080 inches.

7. The case of claim 5, further comprising a primer seated in the pocket.

8. The case of claim 7, wherein the tubular member is formed from a brass alloy.

9. An ammunition cartridge for a firearm comprising:
a case of claim 1, and
a bullet protruding from the bullet receiving end.

10. The ammunition cartridge of claim 9, further comprising a charge of propellant disposed in the internal chamber.

11. The ammunition cartridge of claim 10, wherein the charge of propellant is substantially equal to or less than 5.8 grains of double base propellant.

12. The ammunition cartridge of claim 11, further comprising a first ballistic characteristic, the first ballistic characteristic being muzzle velocity such that the bullet of the ammunition cartridge achieves a muzzle velocity of substantially equal to or greater than 2,600 feet per second.

13. The ammunition cartridge of claim 12, wherein the bullet is a 35 grain bullet.

14. The ammunition cartridge of claim 13, wherein the bullet comprises:
a polymer tip,
a lead core, and
a guilding metal jacket.

15. The ammunition cartridge of claim 9, wherein the bullet is a 36 grain bullet.

16. The ammunition cartridge of claim 15, wherein the bullet comprises a hollow-cavity frangible core surrounded by a guilding metal jacket.

17. The ammunition cartridge of claim 9, wherein the bullet is a 55 grain bullet.

18. The ammunition cartridge of claim 17, wherein the bullet comprises a full metal jacket.

19. The ammunition cartridge of claim 17, further comprising a first ballistic characteristic, the first ballistic characteristic being muzzle velocity such that the bullet of the ammunition cartridge achieves a muzzle velocity of substantially equal to 950 feet per second.

20. An ammunition cartridge in combination with a barrel for a firearm comprising:
an ammunition cartridge comprising a case for an ammunition cartridge of claim 1; and
a barrel chambered for the case of claim 1.

21. The combination of claim 20, wherein the barrel comprises
a cylinder having a central axis which comprises
a distal end which comprises
a muzzle,
a proximal end spaced from the distal end along the central axis which comprises
a breech, and
a breech face circumscribing the breech,
a chamber aligned with the central axis, the chamber comprising
a body segment situated adjacent to the breech face,
a concave curved segment abutting the body segment, the concave curved segment being a third circular curve having a third radius of approximately 0.0263 inches,
a frusto-conical segment abutting the convex curved segment,
a convex curved segment abutting the frusto-conical segment, the convex curved segment being a fourth circular curve having a fourth radius that is substantially equal to 0.1049 inches, the convex curved segment including a shoulder-neck junction, the shoulder-neck junction being spaced from the breech face along the central axis by approximately 0.5278 inches, and the shoulder-neck junction comprises a third reference inner diameter of approximately 0.2596 inches, and
a bore aligned with the central axis, the bore extending from the chamber to the muzzle.

22. A case for an ammunition cartridge in combination with a resizing die for reloading the case comprising:
a case for an ammunition cartridge of claim 1; and
a resizing die for the case.

* * * * *